US008849677B2

(12) United States Patent
Suzuki et al.

(10) Patent No.: US 8,849,677 B2
(45) Date of Patent: Sep. 30, 2014

(54) CODING APPARATUS, CODING METHOD, DECODING APPARATUS, DECODING METHOD, AND PROGRAM

(75) Inventors: Shiro Suzuki, Kanagawa (JP); Yuuki Matsumura, Saitama (JP)

(73) Assignee: Sony Corporation, Tokyo (JP)

( * ) Notice: Subject to any disclaimer, the term of this patent is extended or adjusted under 35 U.S.C. 154(b) by 706 days.

(21) Appl. No.: 13/116,030

(22) Filed: May 26, 2011

(65) Prior Publication Data

US 2011/0301960 A1 Dec. 8, 2011

(30) Foreign Application Priority Data

Jun. 2, 2010 (JP) ..... P2010-126780

(51) Int. Cl.
*G10L 19/00* (2013.01)

(52) U.S. Cl.
USPC ..... 704/500; 704/503; 704/504

(58) Field of Classification Search
USPC ..... 704/205, 500–504, 220–230
See application file for complete search history.

(56) References Cited

U.S. PATENT DOCUMENTS 7,769,584 B2 * 8/2010 Oshikiri et al. ..... 704/230
8,019,597 B2 * 9/2011 Oshikiri ..... 704/205

FOREIGN PATENT DOCUMENTS

JP 4016709 9/2007
JP 3994388 8/2008

* cited by examiner

*Primary Examiner* — Huyen X. Vo
(74) *Attorney, Agent, or Firm* — Finnegan, Henderson, Farabow, Garrett & Dunner, L.L.P.

(57) ABSTRACT

A coding apparatus includes a generation unit configured to generate first coding information used for first coding of a first audio signal and second coding information used for second coding of a second audio signal, and generate third coding information used for the first coding of the second audio signal and fourth coding information used for the second coding of a third audio signal; a first coding unit configured to generate first data and second data; a second coding unit configured to generate third data and fourth data by performing the second coding on the third audio signal; and a multiplexing unit configured to generate a stream of the first audio signal and a stream of the second audio signal. The third data is decoded in place of the second data in a case where a loss or an error has occurred in the stream of the second audio signal.

16 Claims, 23 Drawing Sheets

CODING APPARATUS, CODING METHOD, DECODING APPARATUS, DECODING METHOD, AND PROGRAM

BACKGROUND

The present disclosure relates to a coding apparatus, a coding method, a decoding apparatus, a decoding method, and a program and, more particularly, relates to a coding apparatus, a coding method, a decoding apparatus, a decoding method, and a program that are capable of reducing the bit rate of data for interpolation.

Examples of methods for coding an audio signal, in general, include transform coding methods, such as moving picture experts group audio layer-3 (MP3), advanced audio coding (AAC), and adaptive transform acoustic coding (ATRAC).

FIG. 1 is a block diagram illustrating an example of the configuration of a coding apparatus that codes an audio signal.

A coding apparatus 10 of FIG. 1 is constituted by a modified discrete cosine transform (MDCT) unit 11, a normalization unit 12, a quantization unit 13, a coding unit 14, and a multiplexing unit 15.

A pulse code modulation (PCM) signal T of audio of a predetermined channel is input as a PCM signal T[J] to the MDCT unit 11 of the coding apparatus 10 for each fixed section called a frame. J represents the index of a frame.

The MDCT unit 11 performs windowing of a window function W[J] on a PCM signal T[J] which is a time domain signal, performs MDCT on the PCM signal [J] that is obtained thereby, and obtains a spectrum S[J] that is a frequency domain signal. The MDCT unit 11 supplies the spectrum S[J] to the normalization unit 12.

The normalization unit 12 extracts an envelope F[J] from the spectrum S[J], and supplies it to the multiplexing unit 15. Furthermore, the normalization unit 12 normalizes the spectrum S[J] by using the envelope F[J], and supplies a normalized spectrum N[J] obtained thereby to the quantization unit 13.

The quantization unit 13 quantizes the normalized spectrum N[J] that is supplied from the normalization unit 12 on the basis of quantization accuracy information P[J] determined by a predetermined algorithm, and supplies a quantized spectrum Q[J] obtained thereby to the coding unit 14. Furthermore, the quantization unit 13 supplies the quantization accuracy information P[J] to the multiplexing unit 15. As a predetermined algorithm for determining the quantization accuracy information P[J], for example, algorithms that are already widely available can be used.

The coding unit 14 codes the quantized spectrum Q[J] supplied from the quantization unit 13, and supplies a code spectrum H[J] obtained thereby to the multiplexing unit 15.

The multiplexing unit 15 multiplexes the envelope F[J] supplied from the normalization unit 12, the quantization accuracy information P[J] supplied from the quantization unit 13, and the code spectrum H[J] supplied from the coding unit 14, and generates a bit stream B[J]. The multiplexing unit 15 outputs the bit stream B[J] as a coded result.

FIG. 2 is a block diagram illustrating a decoding apparatus that decodes the coded result by the coding apparatus 10 of FIG. 1.

A decoding apparatus 20 of FIG. 2 is constituted by a decomposition unit 21, a decoding unit 22, a dequantization unit 23, an inverse normalization unit 24, and an inverse MDCT unit 25.

The bit stream B[J], which is the coded result by the coding apparatus 10 of FIG. 1, is input to the decomposition unit 21 of the decoding apparatus 20.

The decomposition unit 21 decomposes the bit stream B[J] into an envelope F[J] and the quantization accuracy information P[J]. Furthermore, the decomposition unit 21 decomposes the bit stream B[J] into a code spectrum H[J] on the basis of the quantization accuracy information P[J]. The decomposition unit 21 supplies the envelope F[J] to the inverse normalization unit 24 and supplies the quantization accuracy information P[J] to the dequantization unit 23. Furthermore, the decomposition unit 21 supplies the code spectrum H[J] to the decoding unit 22.

The decoding unit 22 decodes the code spectrum H[J] supplied from the decomposition unit 21, and supplies the quantized spectrum Q[J] obtained thereby to the dequantization unit 23.

The dequantization unit 23 dequantizes the quantized spectrum Q[J] supplied from the decoding unit 22 on the basis of the quantization accuracy information P[J] supplied from the decomposition unit 21, and supplies the normalized spectrum N[J] obtained thereby to the inverse normalization unit 24.

The inverse normalization unit 24 inversely normalizes the normalized spectrum N[J] supplied from the dequantization unit 23 by using the envelope F[J] supplied from the decomposition unit 21, and supplies the spectrum S[J] obtained thereby to the inverse MDCT unit 25.

The inverse MDCT unit 25 performs inverse MDCT on the spectrum S[J], which is a frequency domain signal supplied from the inverse normalization unit 24, adds up the time domain signal obtained thereby on the basis of the window function W[J], and obtains an audio PCM signal T'[J]. The inverse MDCT unit 25 outputs the PCM signal T'[J] as an audio signal.

As described above, the coding apparatus 10 codes the bit stream B[J] for each frame and outputs it, and the decoding apparatus 20 decodes the bit stream B[J] for each frame. As described above, in the coding apparatus 10 and the decoding apparatus 20, the processing unit is a frame.

FIG. 3 illustrates the PCM signal T[J] and the bit stream B[J].

As shown in part A of FIG. 3, the PCM signal T is a time domain signal. In part A of FIG. 3, the horizontal axis represents time t, and the vertical axis represents the level of a PCM signal.

The coding apparatus 10 performs windowing of a window function W[J] on the PCM signal T[J], which is divided for each frame. As shown in part B of FIG. 3, the window function W[J] is set in such a manner that the first half section thereof overlaps the second half section of the window function W[J−1] of the previous frame, and the second half section of the window function W[J] overlaps the first half section of the window function W[J+1] of the subsequent frame. In an example of FIG. 3, the section of the window function W[J−1] is a section up to time t0 (t0<t1), and the section of the window function W[J] is a section from time t1 to time t3 (t3>t2). The section of the window function W[J+1] is a section from time t2 to time t4 (t4>t3).

The coding apparatus 10 performs MDCT transform, coding, and the like on the PCM signals T[J−1] to T[J+1] obtained by windowing using the window functions W[J−1] to W[J+1], and outputs bit streams B[J−1] to B[J+1] shown in part B of FIG. 3 as coded results.

The decoding apparatus 20 performs decoding, inverse MDCT transform, and the like on the bit streams B[J−1] to B[J+1], and obtains time domain signals of the sections of the window functions W[J−1] to W[J+1]. Then, the decoding apparatus 20 adds the second half section (the section from time t1 to time t2 in the example of FIG. 3) of the time domain signal of the section of the window function W[J−1] and the first half section (the section from time t1 to time t2 in the example of FIG. 3) of the time domain signal of the section of the window function W[J], and obtains a PCM signal T'[J]. Furthermore, the decoding apparatus 20 adds the second half section (the section from time t2 to time t3 in the example of FIG. 3) of the time domain signal of the section of the window function W[J] and the first half section (the section from time t2 to time t3 in the example of FIG. 3) of the time domain signal of the section of the window function W[J+1], and obtains a PCM signal T'[J+1].

Since the coding apparatus 10 performs MDCT, the overlapping sections before and after the window function W[J] in FIG. 3 are each 50% of all the sections. However, when the coding apparatus 10 performs a discrete fourier transform (DFT) rather than MDCT, the overlapping section is not necessary to be 50% of all the sections. Furthermore, windowing may be performed in only one of the coding apparatus 10 and the decoding apparatus 20.

If a bit stream of a certain frame is lost in the procedures of coding and decoding, the PCM signal of the frame is lost, and audible noise may be generated. A description will be given, with reference to FIG. 4, of this case. Part A of FIG. 4 is similar to part A of FIG. 3, and accordingly, the description is omitted.

As shown in part B of FIG. 4, in the decoding apparatus 20, when the bit stream B[J] is lost, the time domain signal of the section of the window function W[J] that should be obtained as a result of coding, an inverse MDCT transform, or the like being performed on the bit stream B[J] is not obtained.

As a result, it is not possible to obtain the PCM signal T'[J] that is generated by using the time domain signal of the first half section of the window function W[J] and the PCM signal T'[J+1] that is generated by using the time domain signal of the second half section of the window function W[J].

Therefore, for example, as shown in part B of FIG. 4, it is considered that the PCM signal T'[J] and the PCM signal T'[J+1] are interpolated using a signal of zero. However, in this case, since the PCM signal becomes noncontinuous in the section from time t1 to time t3, if audio corresponding to the PCM signal in this section is output, a sputtering sound is heard.

Accordingly, a method of interpolating the PCM signal T'[J] of the frame, which is not obtained due to a loss, by using a time domain signal that is not lost, which was scheduled to be used to generate the PCM signal T[J], rather than a signal of zero, is considered. This method will be described with reference to FIG. 5. part A of FIG. 5 is similar to part A of FIG. 3, and accordingly, the description thereof is omitted.

According to the above-mentioned method, as shown in part B of FIG. 5, in the decoding apparatus 20, in a case where the bit stream B[J] is lost, the PCM signal T'[J] is interpolated by the time domain signal of the second half section of the window function W[J−1] that is not lost, which was scheduled to be used to generate the PCM signal T'[J]. Furthermore, the PCM signal T'[J+1] is interpolated using the time domain signal of the first half section of the window function W[J+1] that is not lost, which was scheduled to be used to generate the PCM signal T'[J+1].

According to this method, noncontinuousness of the PCM signal does not occur in the section from time t1 to time t3. However, there is a case in which the time domain signal of the second half section of the window function W[J−1], and the time domain signal of the first half section of the window function W[J+1], which are used for interpolation, markedly differ from the original PCM signal T'[J] and PCM signal T'[J+1]. In this case, when audio corresponding to the PCM signal of the section from time t1 to time t3 is output, also, there is a case in which a sputtering sound is heard.

Accordingly, in order to suppress this noise, a method in which, in a case where the bit stream of a predetermined frame is lost on the decoding side, the coding side resends the bit stream of the frame, has been devised (see, for example, Japanese Patent No. 3994388). However, in this method, there is a case in which the bit stream that is resent does not arrive on time.

Furthermore, a method in which, in a case where the coding side transmits the bit stream of each frame by a plurality of methods and the bit stream of the frame that is transmitted by a predetermined method on the decoding side is lost, the bit stream of the frame, the bit stream being transmitted by another method, is substituted for, has been devised (see, for example, Japanese Patent Application No. 4016709).

FIG. 6 is a block diagram illustrating an example of the configuration of a coding apparatus using this method.

Components shown in FIG. 6, which are identical to the components of FIG. 1, are designated with the same reference numerals. Duplicated descriptions are omitted as appropriate.

The configuration of the coding apparatus 30 of FIG. 6 differs from the configuration of FIG. 1 in that, mainly, a normalization unit 31, a quantization unit 32, a coding unit 33, and a multiplexing unit 34 are newly provided.

The normalization unit 31, the quantization unit 32, the coding unit 33, and the multiplexing unit 34 generate a bit stream C[J] from a spectrum S[J] in the same manner as for the normalization unit 12, the quantization unit 13, the coding unit 14, and the multiplexing unit 15, respectively.

However, since the bit stream C[J] is a preliminary bit stream that is substituted for in a case where the bit stream B[J] is lost, as shown in FIG. 7, the bit rate of the bit stream C[J] is coded in accordance with a coding method different from that of the bit stream B[J] so that the bit rate is decreased to smaller than the bit rate of the bit stream B[J]. Therefore, the sound quality of the audio corresponding to the decoded result of the bit stream C[J] is not good compared to the audio corresponding to the decoded result of the bit stream B[J].

In the coding apparatus 30, the bit stream C[J] that is generated in the manner described above, and the bit stream B[J] that is generated in the same manner as for the coding apparatus 10 are transmitted through different transmission paths.

FIG. 8 is a block diagram illustrating an example of the configuration of a decoding apparatus that decodes a coded result by the coding apparatus 30 of FIG. 6.

A decomposition unit 51, a decoding unit 52, a dequantization unit 53, and an inverse normalization unit 54 of a decoding apparatus 50 of FIG. 8 are basically configured similarly to the decomposition unit 21, the decoding unit 22, the dequantization unit 23, and the inverse normalization unit 24 of FIG. 2, respectively, and differ in that the loss of a bit stream B[J] is detected. The loss of the bit stream B[J] is detected in a case where the bit stream B[J] is lost for some problem in a transmission path or an error occurs in the received bit stream B1[J], and a loss detection result E[J] is supplied from each unit to a switch 59. Furthermore, the spectrum S[J] that is generated from the bit stream B[J] by the decomposition unit 51, the decoding unit 52, the dequantization unit 53, and the inverse normalization unit 54 is supplied to the switch 59.

The decomposition unit 55, the decoding unit 56, the dequantization unit 57, and the inverse normalization unit 58 of the decoding apparatus 50 are the same as the decomposition unit 21, the decoding unit 22, the dequantization unit 23, and the inverse normalization unit 54 of FIG. 2, respectively, except that the target to be processed is a bit stream C[J] and the decoding method is different. The decomposition unit 55, the decoding unit 56, the dequantization unit 57, and the inverse normalization unit 58 decode the bit stream C[J] so as to generate a spectrum S1[J], and supplies it to the switch 59.

In a case where the bit stream B[J] is lost on the basis of the detection result E[J], the switch 59 selects the spectrum S1[J] supplied from the inverse normalization unit 58, and supplies it to the inverse MDCT unit 60. On the other hand, in a case where the bit stream B[J] is not lost on the basis of the detection result E[J], the switch 59 selects the spectrum S[J] supplied from the inverse normalization unit 54, and supplies it to the inverse MDCT unit 60.

The inverse MDCT unit 60 performs inverse MDCT on the spectrum S1[J] or the spectrum S[J], which is a frequency domain signal supplied from the switch 59. Then, the inverse MDCT unit 60 adds up the time domain signal obtained thereby on the basis of the window function W[J], and obtains an audio PCM signal T'1[J]. The inverse MDCT unit 60 outputs the PCM signal T'1[J] as an audio signal.

A description will be given, with reference to FIG. 9, of a case in which the bit stream B[J] is lost in the decoding apparatus 50 configured as described above.

As shown in FIG. 9, in a case where the bit stream B[J] is lost, the spectrum S[J] to be generated from the bit stream B[J] is interpolated using the spectrum S1[J] that is generated from the bit stream C[J]. As a result, it is possible to obtain time domain signals of all the sections of the window function W[J], and it is possible to obtain the PCM signal T'1[J] and the PCM signal T'1[J+1] by using the time domain signal.

The sound quality of the audio corresponding to the bit stream C[J] is not good compared to the bit stream B[J], but it may be that the sound quality is much better than that of the audio whose sound quality is deteriorated due to the loss of the bit stream B[J].

SUMMARY

However, in the method that is disclosed in Japanese Patent Application No. 4016709, the bit rate increases. Specifically, for example, since the bit stream output from the coding apparatus 30 of FIG. 6 is such that the bit stream B[J] and the bit stream C[J] are added, the bit rate of the coding apparatus 30 becomes higher than the bit rate of the coding apparatus 10. Therefore, it is demanded that the bit rate of the bit stream C[J] for interpolation is reduced.

It is desirable to be capable of reducing the bit rate of data for interpolation.

According to an embodiment of the present disclosure, there is provided a coding apparatus including: a generation unit configured to generate first coding information that is information used for first coding of a first audio signal that is an audio signal in a frame unit and second coding information that is information used for second coding of a second audio signal that is an audio signal in a frame unit, the second audio signal being different from the first audio signal, in such a manner that the first coding information and the second coding information share at least a common portion, and configured to generate third coding information that is information used for the first coding of the second audio signal and fourth coding information that is information used for the second coding of a third audio signal that is an audio signal in a frame unit, the third audio signal being different from the first and second audio signals, in such a manner that the third coding information and the fourth coding information share at least a common portion; a first coding unit configured to generate first data by performing the first coding on the first audio signal by using the first coding on the first audio signal by using the first coding information and configured to generate second data by performing the first coding on the second audio signal by using the third coding information; a second coding unit configured to generate third data by performing the second coding on the second audio signal by using the second coding information and configured to generate fourth data by performing the second coding on the third audio signal by using the fourth coding information; and a multiplexing unit configured to generate a stream of the first audio signal by multiplexing the first coding information, the third data, the second coding information, and information other than a portion common to the first coding information within the first data, and configured to generate a stream of the second audio signal by multiplexing the third coding information, the fourth data, and the fourth coding information other than a portion common to the third coding information within the second data, wherein the third data is decoded in place of the second data contained in the stream of the second audio signal in a case where a loss or an error has occurred in the stream of the second audio signal in a decoding apparatus that decodes the first audio signal and the second audio signal.

The coding method and the program according to embodiments of the present disclosure correspond to the coding apparatus according to an embodiment of the present disclosure.

In an embodiment of the present disclosure, first coding information that is information used for first coding of a first audio signal that is an audio signal in a frame unit and second coding information that is information used for second coding of a second audio signal that is an audio signal in a frame unit, the second audio signal being different from the first audio signal, are generated in such a manner that the first coding information and the second coding information share at least a common portion. Third coding information that is information used for the first coding of the second audio signal and fourth coding information that is information used for the second coding of a third audio signal that is an audio signal in a frame unit, the third audio signal being different from the first and second audio signals, are generated in such a manner that the third coding information and the fourth coding information share at least a common portion. First data is generated by performing the first coding on the first audio signal by using the first coding information, and second data is generated by performing the first coding on the second audio signal by using the third coding information. Third data is generated by performing the second coding on the second audio signal by using the second coding information, and fourth data is generated by performing the second coding on the third audio signal by using the fourth coding information. A stream of the first audio signal is generated by multiplexing the first coding information, the third data, the second coding information, and information other than a portion common to the first coding information within the first data, and a stream of the second audio signal is generated by multiplexing the third coding information, the fourth data, and the fourth coding information other than a portion common to the third coding information within the second data. The third data is decoded in place of the second data contained in the stream of the second audio signal in a case where a loss or an error has occurred in the stream of the second audio signal in a decoding apparatus for decoding the streams of the first audio signal and the second audio signal.

According to another embodiment of the present disclosure, there is provided a decoding apparatus including: an obtaining unit configured to obtain a stream of a first audio signal obtained by multiplexing first data obtained as a result of performing first coding on the first audio signal that is an audio signal in a frame unit by using first coding information, the first coding information, second data obtained as a result of performing second coding on a second audio signal that is an audio signal in a frame unit, the second audio signal being different from the first audio signal, by using second coding information, at least a portion of the second coding information being common to the first coding information, and information other than a portion common to the first coding information within the second coding information, and configured to obtain a stream of the second audio signal obtained by multiplexing third data obtained as a result of performing the first coding on the second audio signal by using the third coding information, the third coding information, fourth data obtained as a result of performing the second coding on a third audio signal that is an audio signal in a frame unit, the third audio signal being different from the first and second audio signals by using fourth coding information, at least a portion of the fourth coding information being common to the third coding information, and information other than a portion common to the third coding information within the fourth coding information; a first decoding unit configured to perform first decoding on the first data on the basis of the first coding information and configured to perform the first decoding on the third data on the basis of the third coding information; a second decoding unit configured to perform second decoding on the second data on the basis of the first coding information and configured to perform the second decoding on the fourth data on the basis of the third coding information and the fourth coding information; and an output unit configured to output a decoded result of the second data in place of a decoded result of the third data contained in the stream of the second audio signal in a case where a loss or an error has occurred in the stream of the second audio signal, and configured to output a decoded result of the third data contained in the stream of the second audio signal in a case where a loss or an error has not occurred in the stream of the second audio signal.

The decoding method and the program according to embodiments of the present disclosure correspond to the decoding apparatus according to an embodiment of the present disclosure.

In an embodiment of the present disclosure, there are obtained a stream of a first audio signal obtained by multiplexing first data obtained as a result of performing first coding on the first audio signal that is an audio signal in a frame unit by using first coding information, the first coding information, second data obtained as a result of performing second coding on a second audio signal that is an audio signal in a frame unit, the second audio signal being different from the first audio signal, by using second coding information, at least a portion of the second coding information being common to the first coding information, and information other than a portion common to the first coding information within the second coding information, and a stream of the second audio signal obtained by multiplexing third data obtained as a result of performing the first coding on the second audio signal by using the third coding information, the third coding information, fourth data obtained as a result of performing the second coding on a third audio signal that is an audio signal in a frame unit, the third audio signal being different from the first and second audio signals by using fourth coding information, at least a portion of the fourth coding information being common to the third coding information, and information other than a portion common to the third coding information within the fourth coding information. First decoding is performed on the first data on the basis of the first coding information, and the first decoding is performed on the third data on the basis of the third coding information. Second decoding is performed on the second data on the basis of the first coding information and the second coding information, and the second decoding is performed on the fourth data on the basis of the third coding information and the fourth coding information. A decoded result of the second data is output in place of a decoded result of the third data contained in the stream of the second audio signal in a case where a loss or an error has occurred in the stream of the second audio signal, and a decoded result of the third data contained in the stream of the second audio signal is output in a case where a loss or an error has not occurred in the stream of the second audio signal.

According to another embodiment of the present disclosure, there is provided a coding apparatus including a first coding unit configured to generate first data by coding a first audio signal that is an audio signal in a frame unit and configured to generate second data by coding a second audio signal that is an audio signal in a frame unit, the second audio signal being different from the first audio signal; a second coding unit configured to generate third data by coding a difference between the first audio signal and the second audio signal and configured to generate fourth data by coding a difference between the second audio signal and a third audio signal that is an audio signal in a frame unit, the third audio signal being different from the first and second audio signals; and a multiplexing unit configured to multiplex the first data and the third data so as to generate a stream of the first audio signal and configured to multiplex the second data and the fourth data so as to generate a stream of the second audio signal, wherein the third data is decoded in place of the second data contained in the stream of the second audio signal in a case where a loss or an error has occurred in the stream of the second audio signal in a decoding apparatus that decodes streams of the first audio signal and the second audio signal, and is combined with the decoded result of the first data.

In an embodiment of the present disclosure, first data is generated by coding a first audio signal that is an audio signal in a frame unit, and second data is generated by coding a second audio signal that is an audio signal in a frame unit, the second audio signal being different from the first audio signal. Third data is generated by coding a difference between the first audio signal and the second audio signal, and fourth data is generated by coding a difference between the second audio signal and a third audio signal that is an audio signal in a frame unit, the third audio signal being different from the first and second audio signals. A stream of the first audio signal is generated by multiplexing the first data and the third data, and a stream of the second audio signal is generated by multiplexing the second data and the fourth data. The third data is decoded in place of the second data contained in the stream of the second audio signal in a case where a loss or an error has occurred in the stream of the second audio signal in a decoding apparatus that decodes streams of the first audio signal and the second audio signal, and is combined with the decoded result of the first data.

According to another embodiment of the present disclosure, there is provided a decoding apparatus including: an obtaining unit configured to obtain a stream of a first audio signal obtained by multiplexing first data that is a coded result of a first audio signal that is an audio signal in a frame unit, and second data that is a coded result of a difference between the first audio signal and a second audio signal that is an audio signal in a frame unit, the second audio signal being different from the first audio signal, and a stream of the second audio signal obtained by multiplexing third data that is a coded result of the second audio signal, and fourth data that is a coded result of a difference between the second audio signal and a third audio signal that is an audio signal in a frame unit, the third audio signal being different from the first and second audio signals; a first decoding unit configured to decode the first data and the third data; a second decoding unit configured to decode the second data so as to combine a decoded result of the first data and a decoded result of the second data, and configured to decode the fourth data so as to combine a decoded result of the third data and the fourth decoded result; and an output unit configured to output a combined result of the decoded results of the first data and the second data in place of the decoded result of the third data contained in the stream of the second audio signal in a case where a loss or an error has occurred in the stream of the second audio signal, and configured to output a decoded result of the third data contained in the stream of the second audio signal in a case where a loss or an error has not occurred in the stream of the second audio signal.

In an embodiment of the present disclosure, there are obtained a stream of a first audio signal obtained by multiplexing first data that is a coded result of a first audio signal that is an audio signal in a frame unit, and second data that is a coded result of a difference between the first audio signal and a second audio signal that is an audio signal in a frame unit, the second audio signal being different from the first audio signal, and a stream of the second audio signal obtained by multiplexing third data that is a coded result of the second audio signal, and fourth data that is a coded result of a difference between the second audio signal and a third audio signal that is an audio signal in a frame unit, the third audio signal being different from the first and second audio signals. The first data and the third data are decoded. The second data is decoded so as to combine a decoded result of the first data and a decoded result of the second data. The fourth data is decoded so as to combine a decoded result of the third data and the fourth decoded result. A combined result of the decoded results of the first data and the second data is output in place of the decoded result of the third data contained in the stream of the second audio signal in a case where a loss or an error has occurred in the stream of the second audio signal, and a decoded result of the third data contained in the stream of the second audio signal is output in a case where a loss or an error has not occurred in the stream of the second audio signal.

According to embodiments of the present disclosure, it is possible to reduce the bit rate of data for interpolation.

According to embodiments of the present disclosure, it is possible to perform decoding by using data for interpolation in which the bit rate is reduced.

DESCRIPTION OF EMBODIMENTS

Embodiments

Example of Configuration of Embodiment of Coding Apparatus

Figure 10:
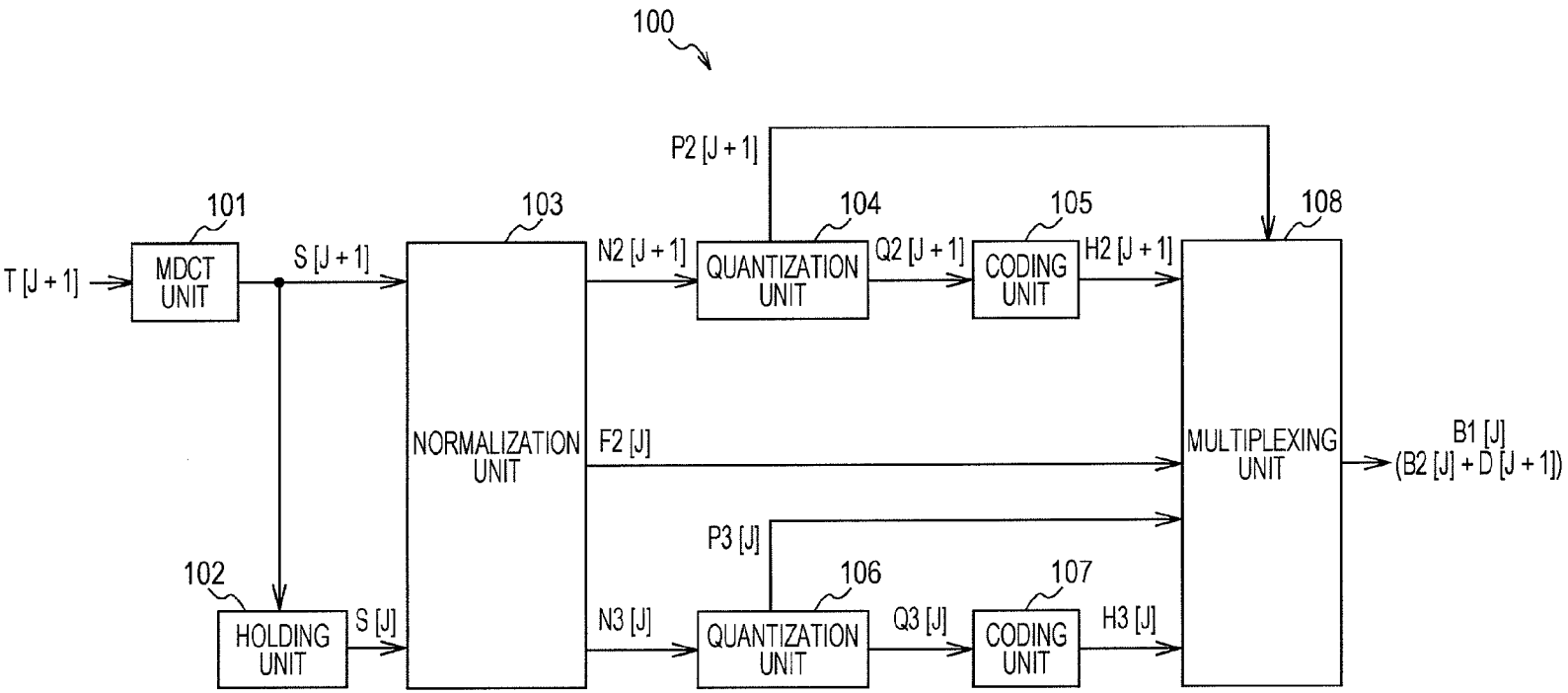
FIG. 10 is a block diagram illustrating an example of the configuration of an embodiment of a coding apparatus to which the present disclosure is applied.

FIG. 10 is a block diagram illustrating an example of the configuration of an embodiment of a coding apparatus to which the present disclosure is applied.

A coding apparatus 100 of FIG. 10 is constituted by an MDCT unit 101, a holding unit 102, a normalization unit 103, a quantization unit 104, a coding unit 105, a quantization unit 106, a coding unit 107, and a multiplexing unit 108.

An audio PCM signal T is input as a PCM signal T[J+1] for each frame to the MDCT unit 101 of the coding apparatus 100.

The MDCT unit 101 performs windowing of a window function W[J+1] on an audio PCM signal T[J+1], which is a time domain signal, performs MDCT on the PCM signal [J+1] obtained thereby, and obtains a spectrum S[J+1] that is a frequency domain signal. The MDCT unit 101 supplies the spectrum S[J+1] to the holding unit 102 and the normalization unit 103.

When the spectrum S[J+1] is supplied from the MDCT unit 101, the holding unit 102 reads the spectrum S[J] of the previous frame, which has already been held, and supplies it to the normalization unit 103. Then, the holding unit 102 holds the spectrum S[J+1] supplied from the MDCT unit 101.

The normalization unit 103 (generation means) extracts an envelope F2[J] common to the spectrum S[J+1] and the spectrum S[J] from the spectrum S[J+1] supplied from the MDCT unit 101 and the spectrum S[J] supplied from the holding unit 102, and supplies the envelope F2[J] to the multiplexing unit 108. Furthermore, the normalization unit 103 normalizes the spectrum S[J+1] by using the envelope F2[J], and supplies a normalized spectrum N2[J+1] obtained thereby to the quantization unit 104. In addition, the normalization unit 103 normalizes the spectrum S[J] by using the envelope F2[J], and supplies a normalized spectrum N3[J] obtained thereby to the quantization unit 106.

On the basis of quantization accuracy information P2[J+1] that is determined by a predetermined algorithm, the quantization unit 104 quantizes the normalized spectrum N2[J+1] supplied from the normalization unit 103, and supplies the quantized spectrum Q2[J+1] obtained thereby to the coding unit 105. Furthermore, the quantization unit 104 supplies the quantization accuracy information P2[J+1] to the multiplexing unit 108. As a predetermined algorithm for determining the quantization accuracy information P2[J+1], for example, algorithms that are already widely available can be used.

The coding unit 105 codes the quantized spectrum Q2[J+1] supplied from the quantization unit 104, and supplies a code spectrum H2[J+1] obtained thereby to the multiplexing unit 108.

On the basis of the quantization accuracy information P3[J] that is determined in accordance with a predetermined algorithm, the quantization unit 106 quantizes the normalized spectrum N3[J] supplied from the normalization unit 103, and supplies a quantized spectrum Q3[J] obtained thereby to the coding unit 107. Furthermore, the quantization unit 106 supplies the quantization accuracy information P3[J] to the multiplexing unit 108. As a predetermined algorithm for determining the quantization accuracy information P3[J], for example, algorithms that are already widely available can be used.

The coding unit 107 codes the quantized spectrum Q3[J] supplied from the quantization unit 106 by using the same coding method as for the coding unit 105. As described above, in the coding apparatus 100, since the coding unit 105 and the coding unit 107 perform coding by using the same coding method, it is possible to simplify the configuration of the coding apparatus 100 compared to the coding apparatus 30 (FIG. 6) of the related art, which performs coding by using a different coding method. In addition, the coding unit 107 supplies a code spectrum H3[J] obtained as a result of the coding to the multiplexing unit 108.

The multiplexing unit 108 multiplexes the envelope F2[J] from the normalization unit 103, the quantization accuracy information P2[J+1] from the quantization unit 104, the code spectrum H2[J+1] from the coding unit 105, the quantization accuracy information P3[J] from the quantization unit 106, and the code spectrum H3[J] from the coding unit 107, and generates a bit stream B1[J]. The multiplexing unit 108 outputs the bit stream B1[J] as a coded result.

The code spectrum H3[J] contained in the bit stream B1[J] is generated as a result of coding the PCM signal T[J], and is a code spectrum that should be originally decoded in the decoding apparatus. On the other hand, the code spectrum H2[J+1] is such that the PCM signal T[J+1] is coded, and is used in place of the code spectrum H3[J+1] in a case where the code spectrum H3[J+1] that should be originally decoded is lost in the decoding apparatus.

Description of Bit Stream

Figure 11:
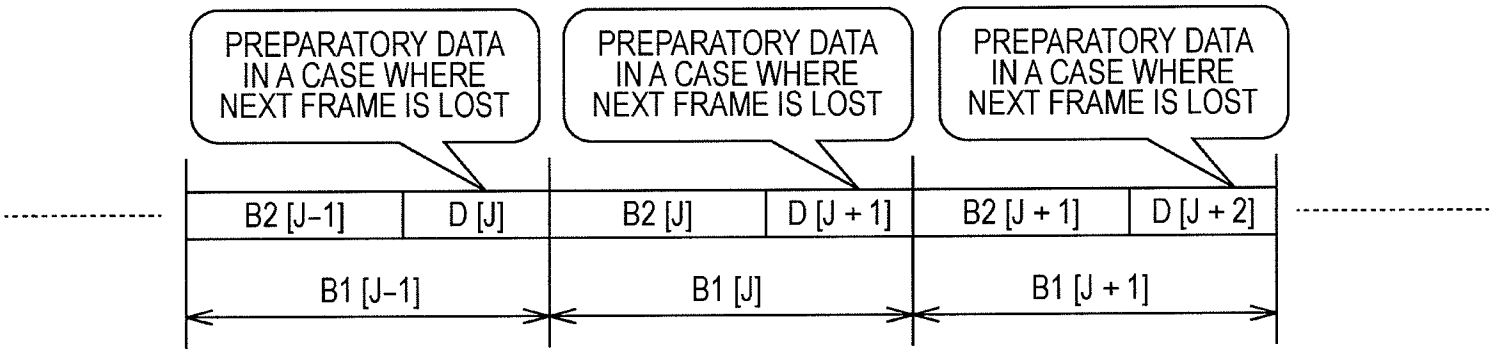
FIG. 11 illustrates a bit stream.

FIG. 11 illustrates a bit stream B1[J] output from the coding apparatus 100 of FIG. 10.

As shown in FIG. 11, the bit stream B1[J] is composed of data B2[J] containing the code spectrum H3[J] that should be originally decoded, and data D[J+1] containing the code spectrum H2[J+1] that is substituted for when the code spectrum H3[J+1] of the frame next to the frame of the code spectrum H3[J] is lost.

As described above, since the frame corresponding to the data B2[J] contained in the same bit stream B1[J] differs from the frame corresponding to the data D[J+1], it is possible to prevent the data B2[J] and the data D[J] of the same frame from being simultaneously lost.

Figure 1:
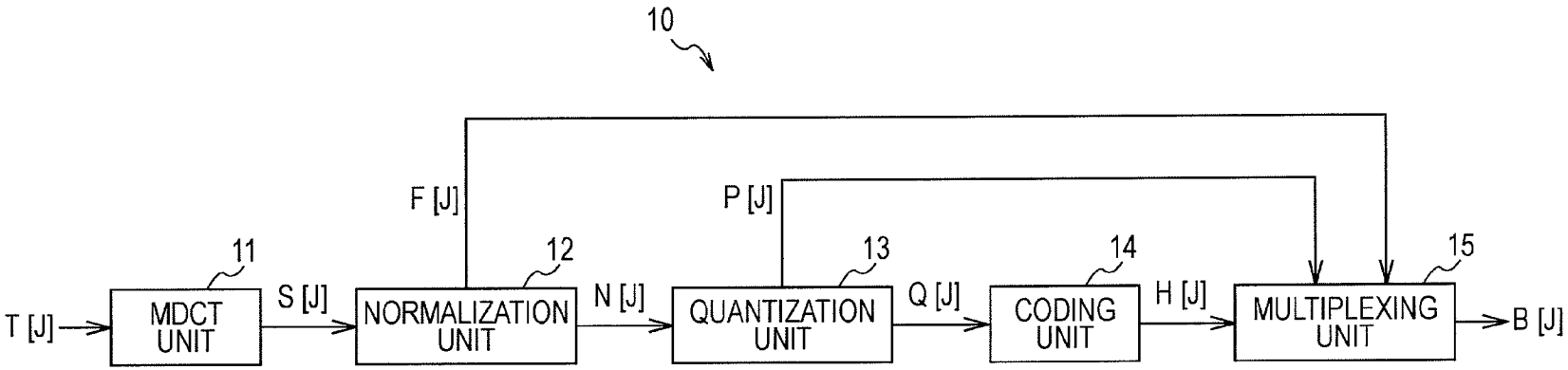
FIG. 1 is a block diagram illustrating an example of the configuration of a coding apparatus of the related art.
Figure 2:
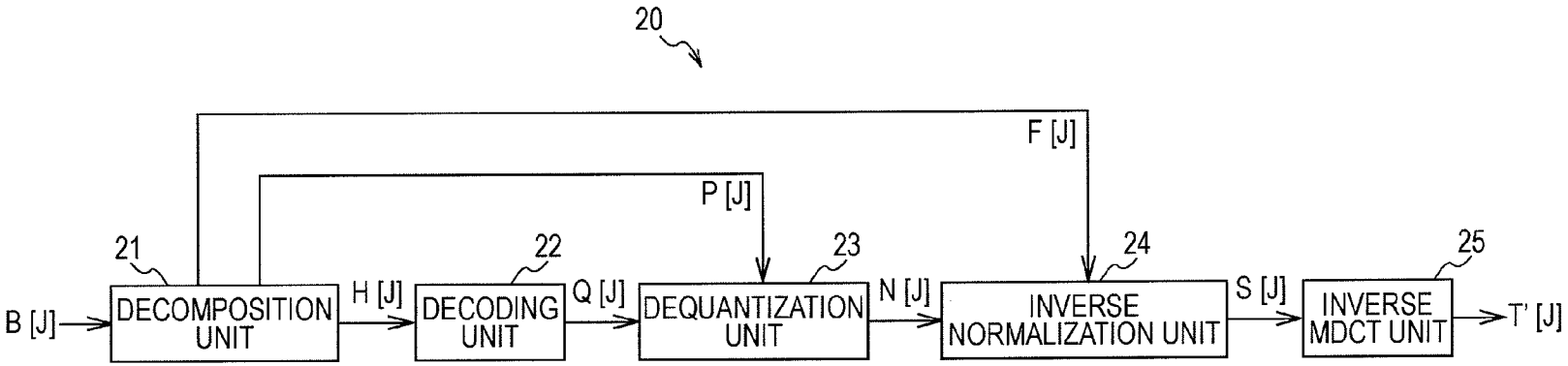
FIG. 2 is a block diagram illustrating an example of the configuration of a decoding apparatus corresponding to the coding apparatus of FIG. 1.
Figure 3:
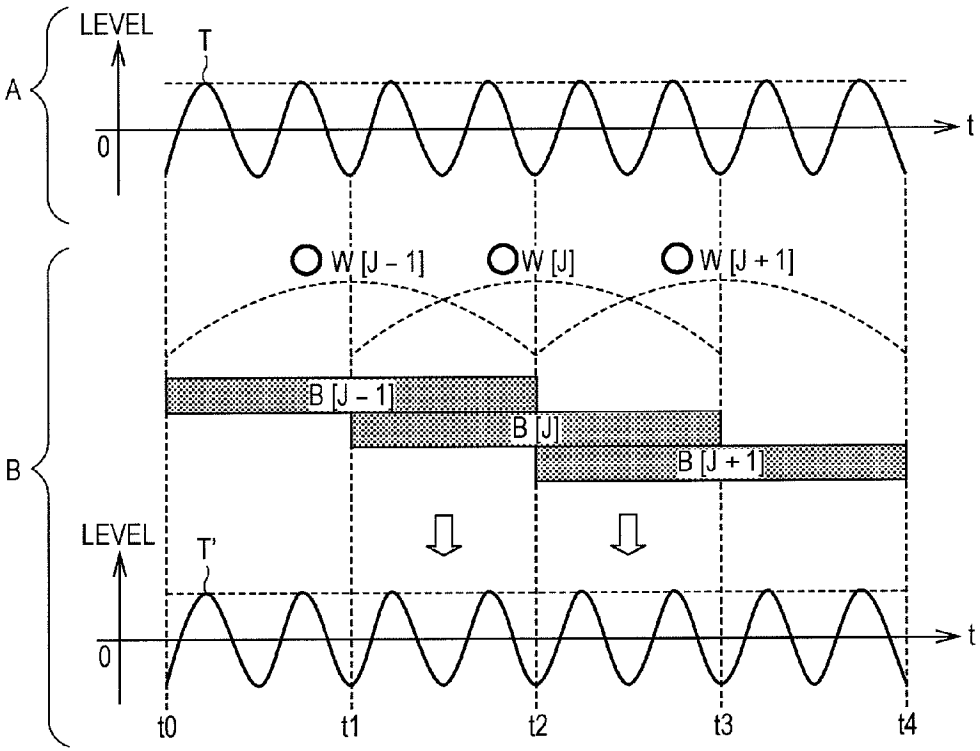
FIG. 3 illustrates a PCM signal and a bit stream.
Figure 4:
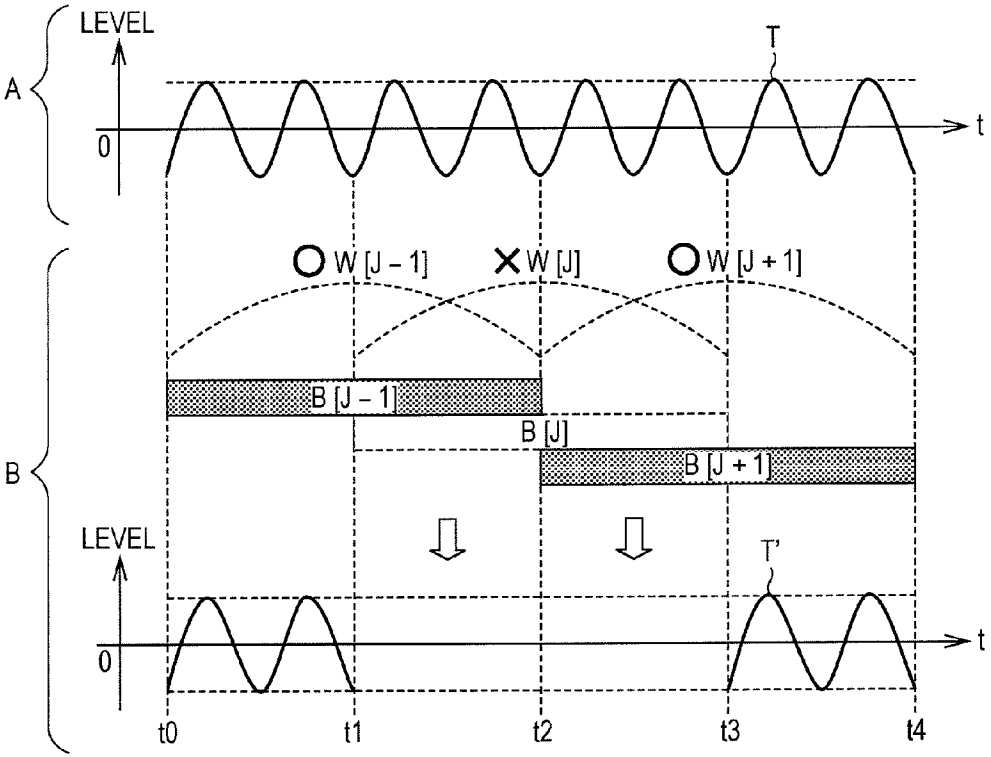
FIG. 4 illustrates a PCM signal when a bit stream is lost.
Figure 5:
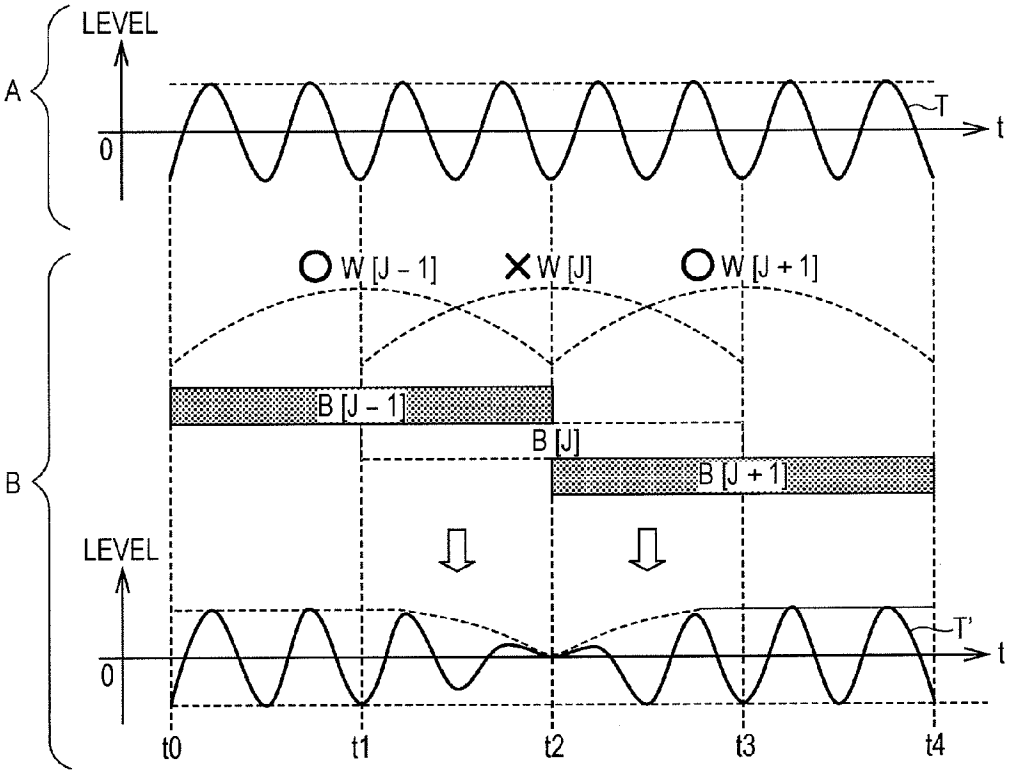
FIG. 5 illustrates an example of interpolation when a bit stream is lost.
Figure 6:
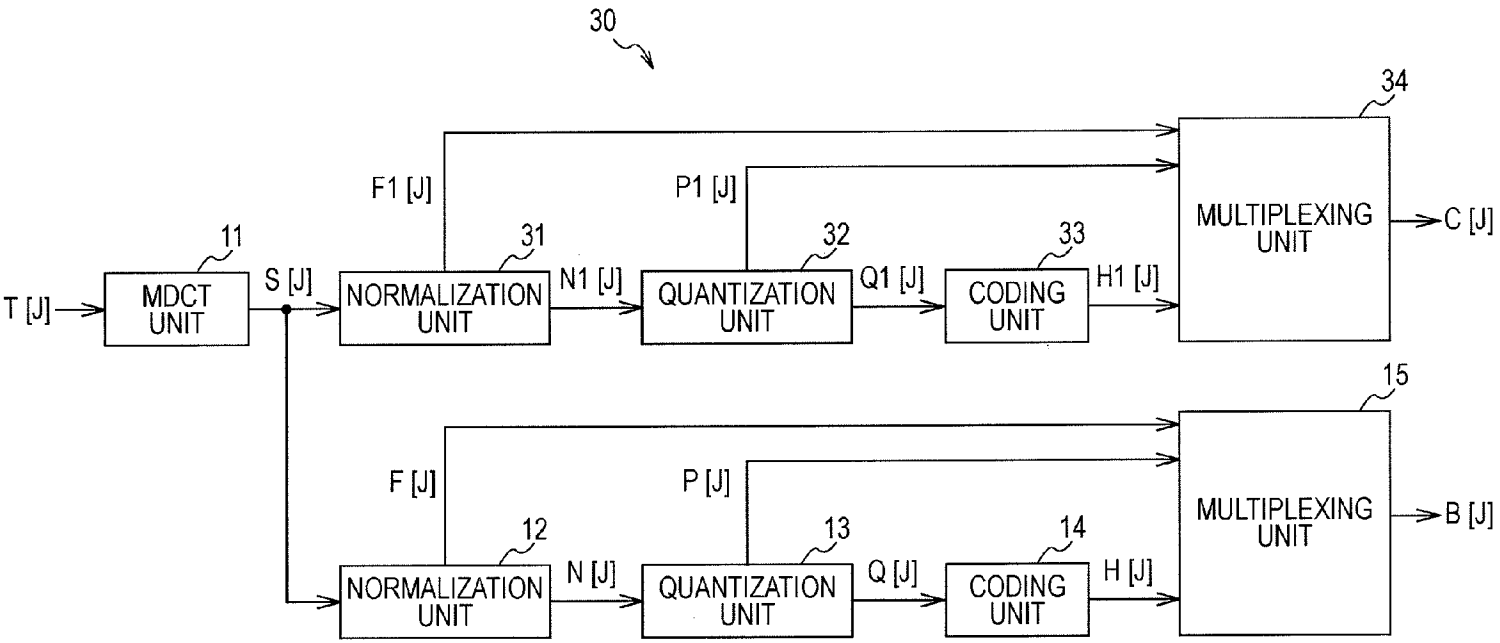
FIG. 6 is a block diagram illustrating another example of the configuration of the coding apparatus of the related art.
Figure 7:
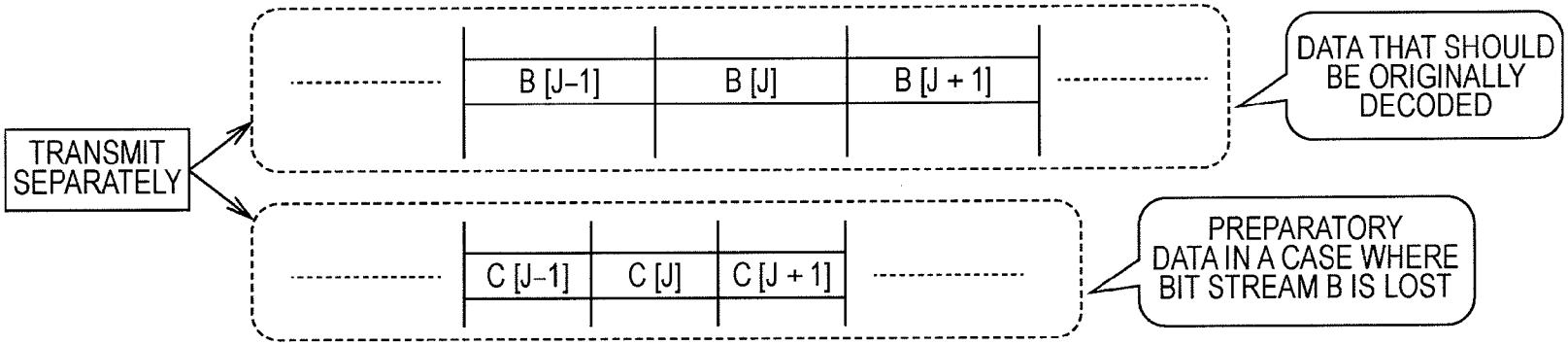
FIG. 7 illustrates the bit rate of each of bit streams.
Figure 12A:
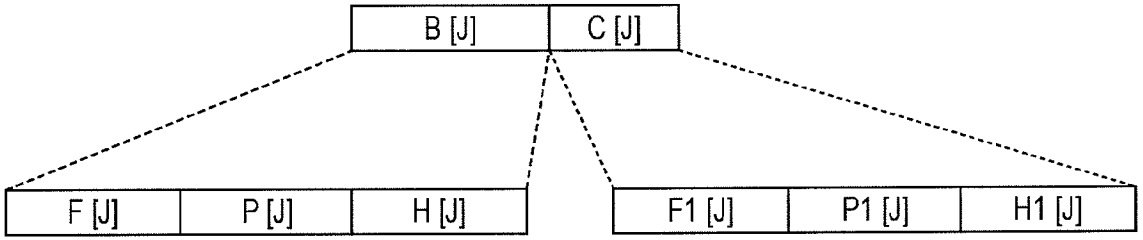
FIGS. 12A and 12B illustrate the amount of data of a coded result of the related art and a coded result of the present disclosure.
Figure 12B:
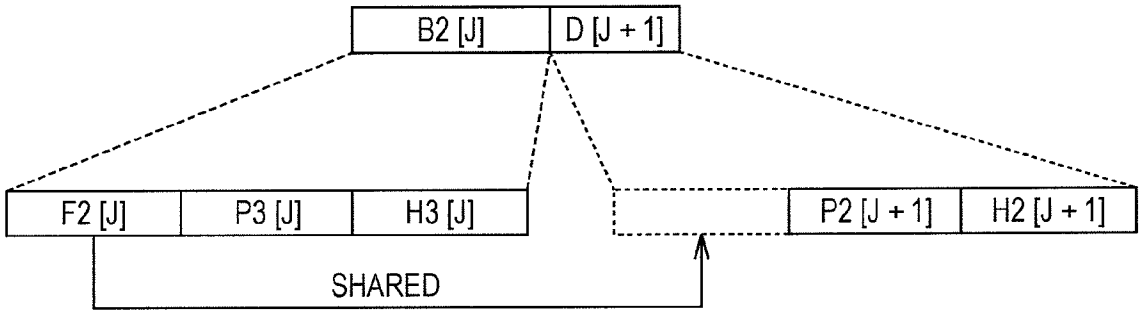

FIGS. 12A and 12B illustrate the amount of data of a coded result by the coding apparatus 30 of FIG. 6 of the related art and a coded result by the coding apparatus 100 of FIG. 10.

As shown in FIG. 12A, the coded result by the coding apparatus 30 of FIG. 6 is composed of the bit stream B[J] that should be originally decoded and the bit stream C[J] that is substituted for when the bit stream B[J] is lost. Furthermore, the bit stream B[J] is composed of the envelope F[J], the quantization accuracy information P[J], and the code spectrum H[J], and the bit stream C[J] is composed of the envelope F1[J], the quantization accuracy information P1[J], and the code spectrum H1[J].

On the other hand, as shown in FIG. 12B, the coded result by the coding apparatus 100 of FIG. 10 is composed of the data B2[J] that should be originally decoded, and the data D[J+1] that is substituted for when the data B2[J+1] is lost. Furthermore, the data B2[J] is composed of the code spectrum H3[J], the quantization accuracy information P3[J] necessary to decode the code spectrum H3[J], and the envelope F2[J] common to the code spectrum H3[J] and the code spectrum H2[J+1]. The data D[J+1] is composed of the code spectrum H2[J+1] and the quantization accuracy information P2[J+1].

As described above, in the coded result by the coding apparatus 100, the code spectrum H3[J] and the code spectrum H2[J+1] share a common envelope. Therefore, in a case where the coding apparatus 30 performs coding by using the same coding method as for the coding apparatus 100, it is possible to decrease the size of the data for interpolation, that is, the data that is substituted for at the time of a loss when compared to the coded result by the coding apparatus 30. As a result, it is possible to reduce the bit rate of the data for interpolation, and it is possible to reduce the transmission cost.

Description of Sharing Envelope

FIG. 13 to FIG. 18 illustrate the process of sharing an envelope.

Figure 13:
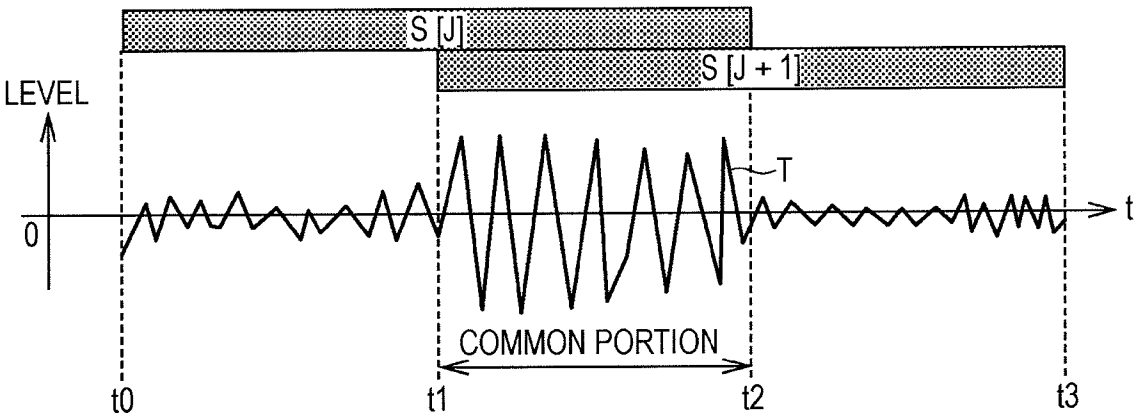
FIG. 13 illustrates an example of a PCM signal that is dominant in terms of energy.

First, a description will be given of a case in which, as shown in FIG. 13, a PCM signal is a signal whose wave height is high and which is dominant in terms of energy in a section from time t1 to time t2.

Figure 14A:
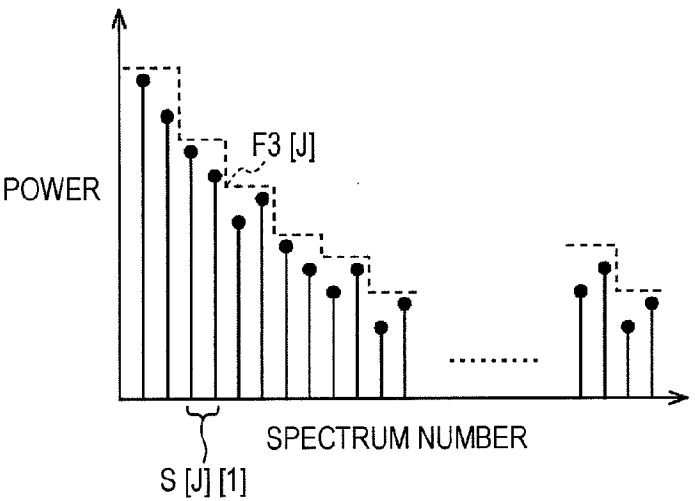
FIGS. 14A and 14B illustrate a spectrum distribution of a spectrum of the PCM signal of FIG. 13.
Figure 14A:
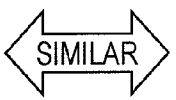
Figure 14B:
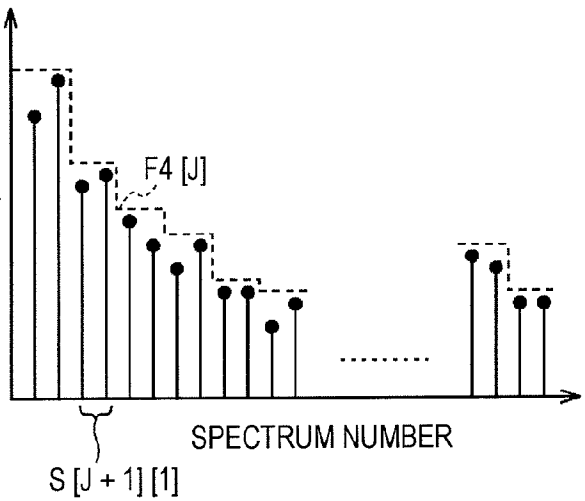

In this case, as shown in FIG. 13, when a spectrum S[J] is generated by using the signal in a section from time t0 to time t2 of a PCM signal T, the spectrum distribution of the spectrum S[J] is as shown in FIG. 14A. Furthermore, when a spectrum S[J+1] is generated by using the signal in the section from time t1 to time t3 of the PCM signal T, the spectrum distribution of the spectrum S[J+1] is as shown in FIG. 14B. In a case where the power of the spectrum is obtained by performing a frequency transform on a time signal, the phase information of the time signal is lost, and only the power information of the spectrum exists. Here, in the spectrum S[J] and the spectrum S[J+1], since the PCM signal in the section from time t1 to time t2 in which the energy is dominant is shared, as shown in FIGS. 14A and 14B, the shape of the spectrum S[J] resembles that of the spectrum S[J+1]. In FIGS. 14A and 14B, the horizontal axis represents the spectrum number, and the vertical axis represents the power of the spectrum. This also applies to FIGS. 17A and 17B, which will be described later.

Here, the envelope is often obtained in units of a plurality of spectra, as indicated by the dotted line in FIGS. 14A and 14B. In the example of FIGS. 14A and 14B, it is assumed that the envelope is obtained in units of a spectrum group formed from two spectra, and the index of the spectrum group is attached in sequence from 0 in ascending order of the spectrum number. In the following, the spectrum group of the index i of a J frame is represented as S[J][i].

Figure 15:
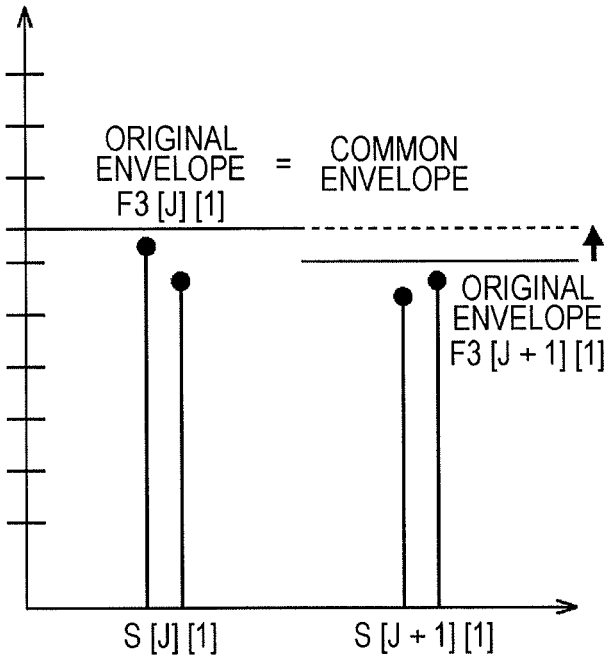
FIG. 15 illustrates an envelope of the spectrum of FIG. 14.

FIG. 15 illustrates envelopes of a spectrum group S[J][1] and a spectrum group S[J+1][1].

As shown in FIGS. 14A and 14B, the spectrum group S[J][1] and the spectrum group S[J+1][1] resemble each other. Therefore, as shown in FIG. 15, the envelope F3[J][1] of the spectrum group S[J][1] resembles the envelope F3[J+1][1] of the spectrum group S[J+1][1]. Therefore, even if the larger of the envelope F3[J][1] of the spectrum group S[J][1] and the envelope F3[J+1][1] of the spectrum group S[J+1][1] is used as an envelope common to the spectrum group S[J][1] and the spectrum group S[J+1][1], the shapes of the normalized spectrum N3[J] and the normalized spectrum N2[J+1] do not change greatly.

Therefore, as shown in FIG. 13, in a case where the PCM signal is a signal whose wave height is high and which is dominant in terms of energy in the overlapping section of the window function W[J], by using the larger of the envelope F3[J][i] of the spectrum group S[J][i] and the envelope F3[J+1][i] of the spectrum group S[J+1][i] as an envelope common to the spectrum group S[J][i] and the spectrum group S[J+1][i], it is possible to cause the spectrum group S[J][i] and the spectrum group S[J+1][i] to share a common envelope.

Figure 16:
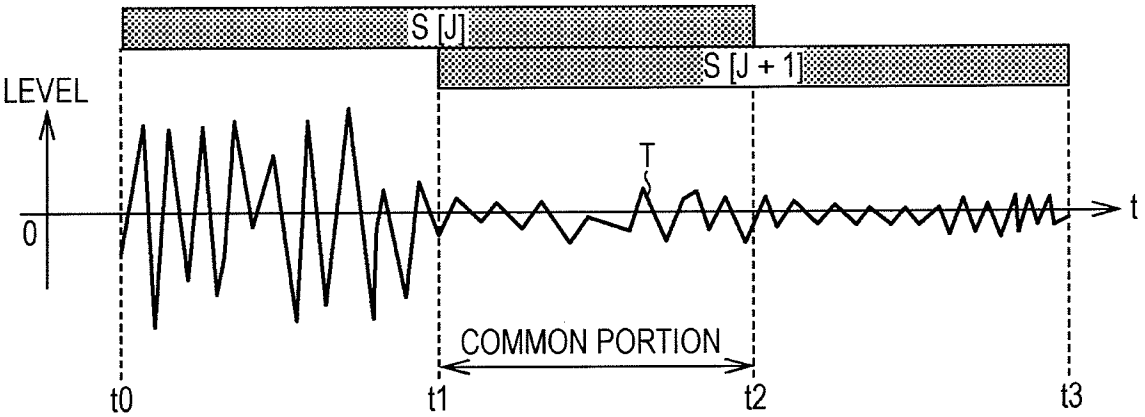
FIG. 16 illustrates an example of a PCM signal in which energy is not concentrated in an overlapping section.

Next, a description will be given of a case in which, as shown in FIG. 16, the PCM signal is a signal in which the energy is not concentrated in the section from time t1 to time t2, and whose wave height is high and which is dominant in terms of energy in the section from time t0 to time t1.

Figure 17A:
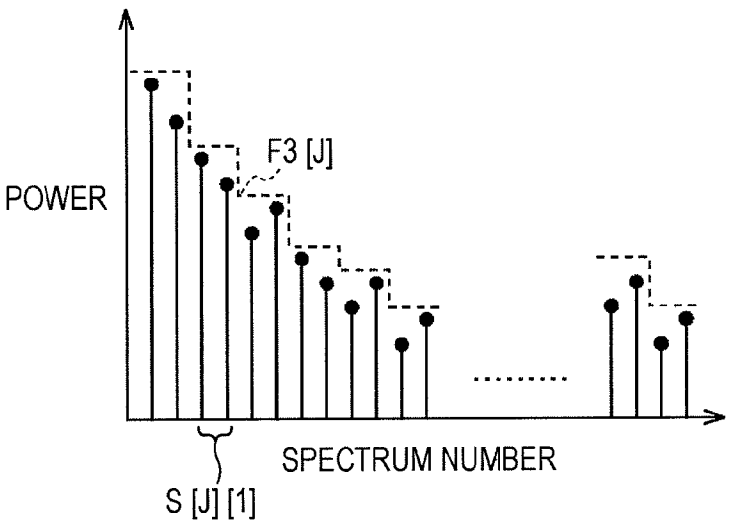
FIGS. 17A and 17B illustrate the spectrum distribution of the spectrum of the PCM signal of FIG. 16.
Figure 17A:
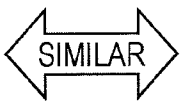
Figure 17B:
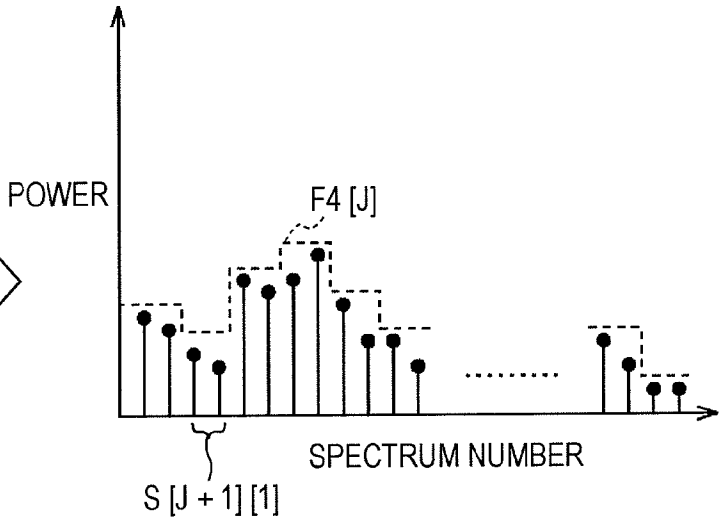

In this case, as shown in FIG. 16, similarly to the case of FIG. 13, when the spectrum S[J] is generated by using a signal in the section from time t0 to time t2 of the PCM signal T, the spectrum distribution of the spectrum S[J] is as shown in FIG. 17A. Furthermore, similarly to the case of FIG. 13, when the spectrum S[J+1] is generated by using the signal in the section from time t1 to time t3 of the PCM signal T, the spectrum distribution of the spectrum S[J+1] is as shown in FIG. 17B. As shown in FIGS. 17A and 17B, the similarity between the spectrum shapes of the spectrum S[J] and the spectrum S[J+1] is decreased. The reason for this is that the PCM signal in the section from time t0 to time t1, whose wave height is high and which is dominant in terms of energy, affects the spectrum S[J], but does not affect the spectrum S[J+1].

Here, in the example of FIGS. 17A and 17B, also, similarly to the case of FIGS. 14A and 14B, it is assumed that the envelope is obtained in units of a spectrum group formed of two spectra, and the indexes of the spectrum group are attached in sequence starting from 0 in ascending order of the spectrum number.

Figure 18:
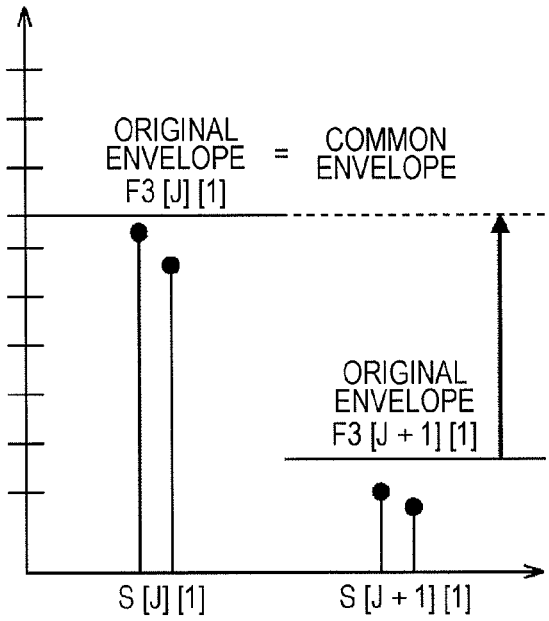
FIG. 18 illustrates the envelope of the spectrum of FIG. 17.

FIG. 18 illustrates envelopes of the spectrum group S[J][1] and the spectrum group S[J+1][1].

As shown in FIGS. 17A and 17B, the spectrum group S[J][1] does not resemble the spectrum group S[J+1][1]. Therefore, as shown in FIG. 18, the envelope F3[J] of the spectrum group S[J][1] does not resemble the envelope F4[J] of the spectrum group S[J+1][1]. Therefore, in a case where the larger of the envelope F3[J][1] of the spectrum group S[J][1] and the envelope F3[J+1][1] of the spectrum group S[J+1][1] is used as an envelope common to the spectrum group S[J][1] and the spectrum group S[J+1][1], a normalized spectrum N2[J+1][1] of the spectrum group S[J+1][1] becomes a very small value, and there is a case in which the normalized spectrum N2[J+1][1] will be coded as all zeros in the subsequent quantization. Therefore, in this case, the shape of the normalized spectrum N2[J+1][1] in a case where it is normalized by using the envelope F3[J+1][1] of the spectrum group S[J+1][1] greatly differs from the shape of the normalized spectrum N2[J+1][1] in a case where it is normalized by using a common envelope.

However, in the decoding, since the influence exerted by a spectrum having small power on the accuracy worsening of a spectrum having large power is small to begin with, no problem is posed.

Therefore, as shown in FIG. 16, even in a case where the PCM signal is a signal in which energy is not concentrated in the overlapping section of the window function W[J], by using the larger of the envelope F3[J][i] of the spectrum group S[J][i] and the envelope F3[J+1][i] of the spectrum group S[J+1][i] as an envelope common to the spectrum group S[J][i] and the spectrum group S[J+1][i], it is possible to cause the spectrum group S[J][i] and the spectrum group S[J+1][i] to share a common envelope.

Occurrence of noise due to the loss of a frame, in most cases, is caused by noncontinuousness of low frequency components. More specifically, between consecutive frames, audible noise occurs as a result of low frequency components that are continuously generated at a fixed level being lost in only a specific frame. When this is considered, in the PCM signal T as shown in FIG. 16, low frequency components are not generated at a fixed level, that is, are not continuous between a J frame and a J+1 frame to begin with. Consequently, it can be seen that the program is a signal in which audible noise is difficult to occur even if data D[J+1] is not used. Therefore, in practice, it is not necessary to transmit the data D[J+1].

However, since the loss of a frame occurs involuntarily, it is not possible to determine in advance whether or not a frame that is lost is a frame that easily causes audible noise to occur as a result of the loss. Therefore, in the coding apparatus 100, the data D[J+1] is transmitted regardless of whether or not each frame is a frame in which audible noise occurs easily as a result of the loss of a frame.

In a case where audible noise occurs easily as a result of the loss of a frame, that is, in a case where low frequency components are continuous, since the envelopes of conductive frames resemble each other, many values that are not zero are coded as data D[J]. On the other hand, in a case where audible noise is difficult to occur as a result of the loss of a frame, the envelopes of consecutive frames do not resemble each other, and many values that are zero or close to zero are sometimes coded. Therefore, if the closer to zero the value, the shorter coding length the value is coded at, it is possible to automatically vary the bit rate of the data D[J] according to the occurrence probability of noise.

Description of Processing of Coding Apparatus

Figure 19:
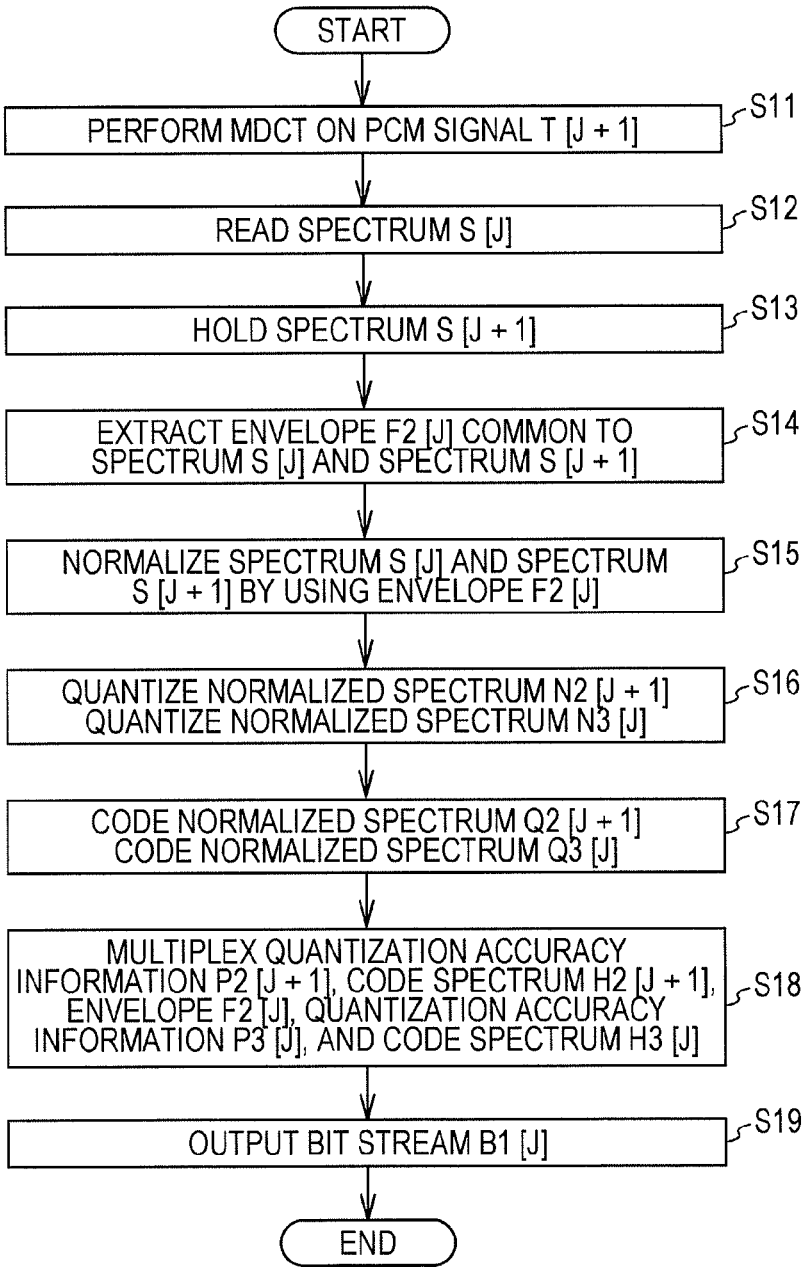
FIG. 19 is a flowchart illustrating a coding process performed by the coding apparatus of FIG. 10.

FIG. 19 is a flowchart illustrating a coding process performed by the coding apparatus 100 of FIG. 10. This coding process is started when, for example, an audio PCM signal T[J+1] is input to the coding apparatus 100.

In step S11 of FIG. 19, the MDCT unit 101 performs windowing of a window function W[J+1] on the PCM signal T[J+1], which is a time domain signal, performs MDCT on the PCM signal [J+1] obtained thereby, and obtains a spectrum S[J+1], which is a frequency domain signal. The MDCT unit 101 supplies the spectrum S[J+1] to the holding unit 102 and the normalization unit 103.

In step S12, the holding unit 102 reads the spectrum S[J] of the previous frame, which has already been held, and supplies it to the normalization unit 103.

In step S13, the holding unit 102 holds the spectrum S[J+1] supplied from the MDCT unit 101.

In step S14, the normalization unit 103 extracts an envelope F2[J] common to the spectrum S[J] and the spectrum S[J+1] from the spectrum S[J] supplied from the holding unit 102 and the spectrum S[J+1] supplied from the MDCT unit 101. Specifically, the normalization unit 103 extracts the larger envelope between the envelope of the spectrum S[J+1] and the envelope of the spectrum S[J] as a common envelope F2[J]. Then, the normalization unit 103 supplies the envelope F2[J] to the multiplexing unit 108.

In step S15, the normalization unit 103 normalizes the spectrum S[J] and the spectrum S[J+1] by using the envelope F2[J]. The normalization unit 103 supplies the normalized spectrum N3[J] obtained as a result of the normalization of the spectrum S[J] to the quantization unit 106. Furthermore, the normalization unit 103 supplies the normalized spectrum N2[J+1] obtained as a result of the normalization of the spectrum S[J+1] to the quantization unit 104.

In step S16, on the basis of the quantization accuracy information P2[J+1] determined by a predetermined algorithm, the quantization unit 104 quantizes the normalized spectrum N2[J+1] supplied from the normalization unit 103, and supplies the quantized spectrum Q2[J+1] obtained thereby to the coding unit 105. Furthermore, the quantization unit 104 supplies the quantization accuracy information P2[J+1] to the multiplexing unit 108. At the same time, on the basis of the quantization accuracy information P3[J] that is determined by the predetermined algorithm, the quantization unit 106 quantizes the normalized spectrum N3[J] supplied from the normalization unit 103, and supplies the quantized spectrum Q3[J] obtained thereby to the coding unit 107. Furthermore, the quantization unit 106 supplies the quantization accuracy information P3[J] to the multiplexing unit 108.

In step S17, the coding unit 105 codes the quantized spectrum Q2[J+1] supplied from the quantization unit 104, and supplies the code spectrum H2[J+1] obtained thereby to the multiplexing unit 108. At the same time, the coding unit 107 codes the quantized spectrum Q3[J] supplied from the quantization unit 106, and supplies the code spectrum H3[J] obtained thereby to the multiplexing unit 108.

In step S18, the multiplexing unit 108 multiplexes the quantization accuracy information P2[J+1] from the quantization unit 104, the code spectrum H2[J+1] from the coding unit 105, the envelope F2[J] from the normalization unit 103, the quantization accuracy information P3[J] from the quantization unit 106, and the code spectrum H3[J] from the coding unit 107, and generates a bit stream B1[J].

In step S19, the multiplexing unit 108 outputs the generated bit stream B1[J] as a coded result, and the processing is completed.

Example of Configuration of Decoding Apparatus

Figure 20:
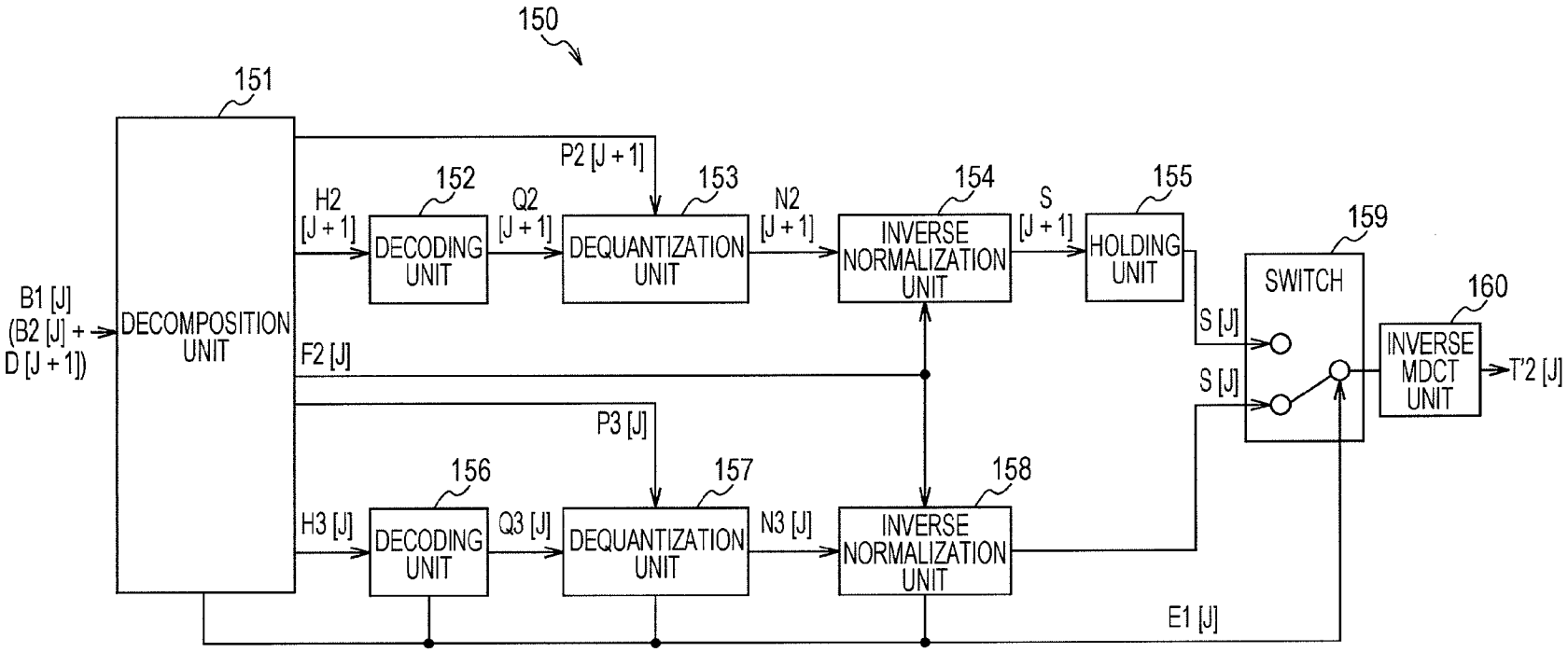
FIG. 20 is a block diagram illustrating an example of the configuration of a decoding apparatus corresponding to the coding apparatus of FIG. 10.

FIG. 20 illustrates an example of the configuration of a decoding apparatus that decodes a coded result by the coding apparatus 100 of FIG. 10.

A decoding apparatus 150 of FIG. 20 is constituted by a decomposition unit 151, a decoding unit 152, a dequantization unit 153, an inverse normalization unit 154, a holding unit 155, a decoding unit 156, a dequantization unit 157, an inverse normalization unit 158, a switch 159, and an inverse MDCT unit 160.

The bit stream B1[J], which is a coded result by the coding apparatus 100, is input to the decomposition unit 151 of the decoding apparatus 150.

The decomposition unit 151 (obtaining means) obtains the bit stream B1[J]. The decomposition unit 151 decomposes the bit stream B1[J] into an envelope F2[J], quantization accuracy information P2[J+1], and quantization accuracy information P3[J]. Furthermore, the decomposition unit 151 decomposes the bit stream B1[J] into a code spectrum H2[J+1] on the basis of the quantization accuracy information P2[J+1], and decomposes the bit stream B1[J] into a code spectrum H3[J] on the basis of the quantization accuracy information P3[J].

Furthermore, the decomposition unit 151 supplies the envelope F2[J] to the inverse normalization unit 154 and the inverse normalization unit 158. The decomposition unit 151 supplies the quantization accuracy information P2[J+1] to the dequantization unit 153 and supplies the quantization accuracy information P3[J] to the dequantization unit 157.

In addition, the decomposition unit 151 supplies the code spectrum H2[J+1] to the decoding unit 152, and supplies the code spectrum H3[J] to the decoding unit 156.

The decoding unit 152 decodes the code spectrum H2[J+1] supplied from the decomposition unit 151, and supplies the quantized spectrum Q2[J+1] obtained thereby to the dequantization unit 153.

The dequantization unit 153 dequantizes the quantized spectrum Q2[J+1] supplied from the decoding unit 152 on the basis of the quantization accuracy information P2[J+1] supplied from the decomposition unit 151, and supplies the normalized spectrum N2[J+1] obtained thereby to the inverse normalization unit 154.

The inverse normalization unit 154 inversely normalizes the normalized spectrum N2[J+1] supplied from the dequantization unit 153 by using the envelope F2[J] supplied from the decomposition unit 151, and supplies the spectrum S[J+1] obtained thereby to the holding unit 155.

When the spectrum S[J+1] is supplied from the inverse normalization unit 154, the holding unit 155 reads the spectrum S[J] that has already been held, and outputs it to the switch 159. Furthermore, the holding unit 155 holds the spectrum S[J+1] supplied from the inverse normalization unit 154.

Figure 8:
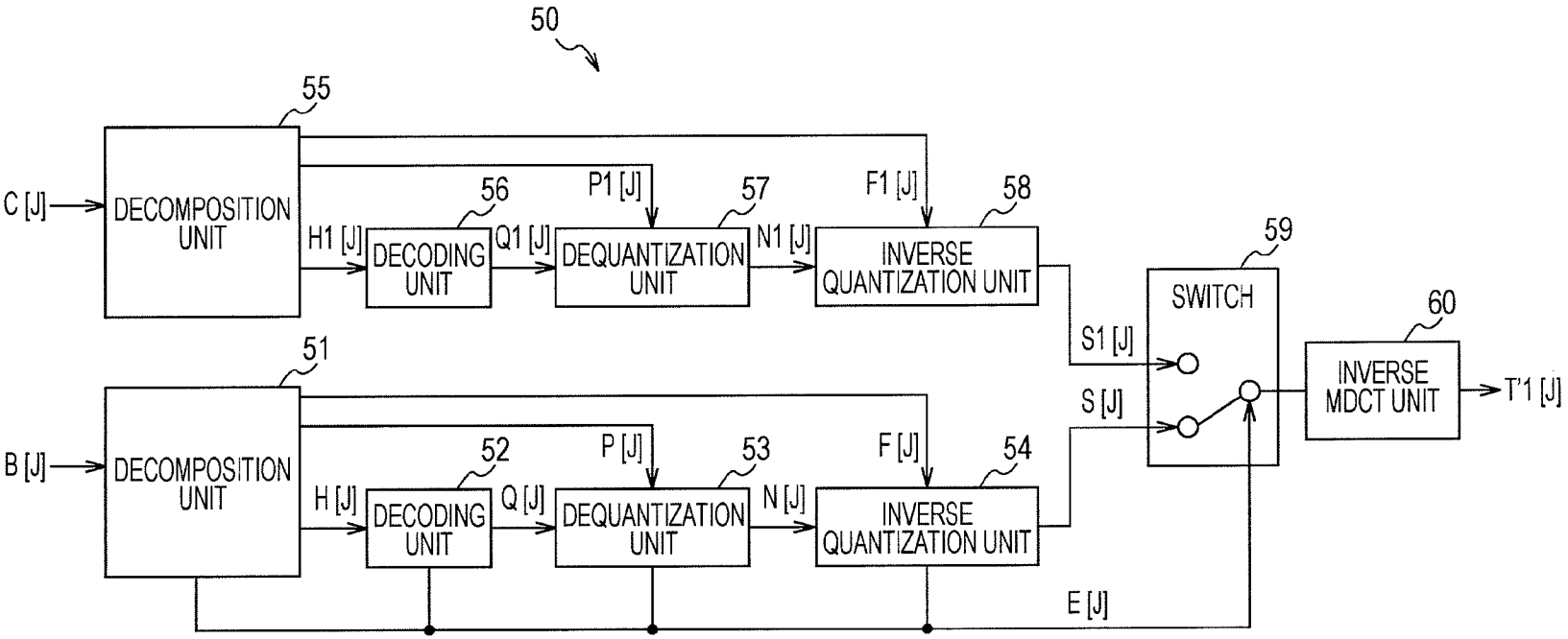
FIG. 8 is a block diagram illustrating an example of the configuration of a decoding apparatus corresponding to the coding apparatus of FIG. 6.
Figure 9:
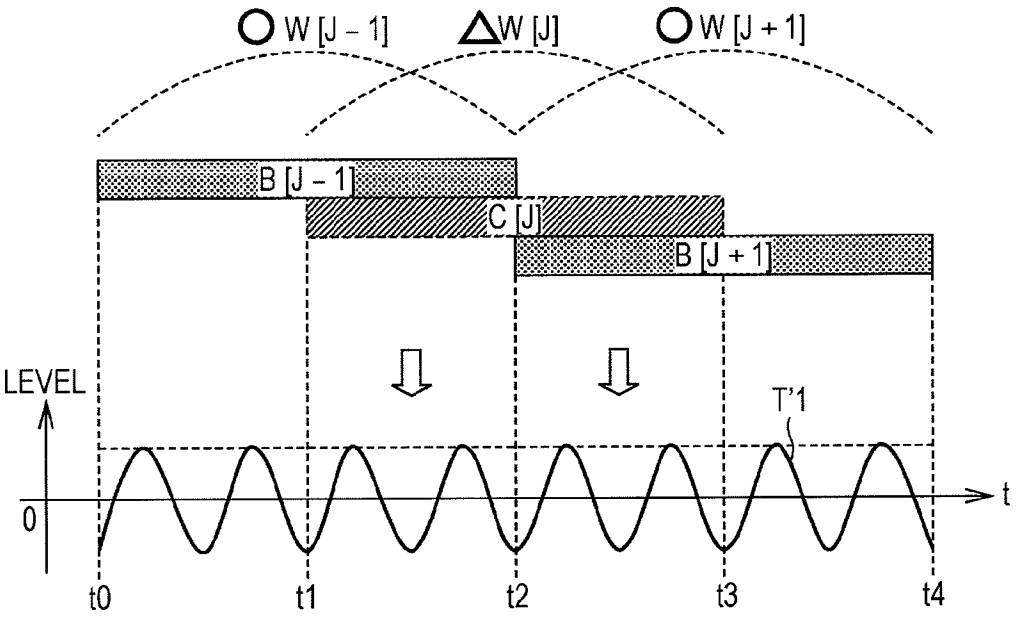
FIG. 9 illustrates another example of interpolation when a bit stream is lost.

The decoding unit 156 decodes the code spectrum H3[J] supplied from the decomposition unit 151 by the same decoding method as that of the decoding unit 152. As described above, in the decoding apparatus 150, since the decoding unit 152 and the decoding unit 156 perform decoding by the same decoding method, it is possible to simplify the configuration of the decoding apparatus 150 when compared to the decoding apparatus 50 (FIG. 8) of the related art, which performs decoding by a different decoding method. Furthermore, the decoding unit 156 supplies the quantized spectrum Q3[J] obtained as a result of the decoding to the dequantization unit 157.

The dequantization unit 157 dequantizes the quantized spectrum Q3[J] supplied from the decoding unit 156 on the basis of the quantization accuracy information P3[J] supplied from the decomposition unit 151, and supplies the normalized spectrum N3[J] obtained thereby to the inverse normalization unit 158.

The inverse normalization unit 158 inversely normalizes the normalized spectrum N3[J] supplied from the dequantization unit 157 by using the envelope F2[J] supplied from the decomposition unit 151, and supplies the spectrum S[J] obtained thereby to the switch 159.

The decomposition unit 151, the decoding unit 156, the dequantization unit 157, and the inverse normalization unit 158 each further detect that the data B2[J] is lost for some problem in the transmission path and an error has occurred in the data B2[J]. Then, the detection result is supplied as a loss detection result E1[J] to the switch 159.

On the basis of the detection result E1[J], the switch 159 (output means) selects the spectrum S[J] obtained from the data D[J] supplied from the holding unit 155 or the spectrum S[J] obtained from the data B2[J] supplied from the inverse normalization unit 158, and supplies the spectrum S[J] to the inverse MDCT unit 160.

The inverse MDCT unit 160 performs inverse MDCT on the spectrum S[J] that is a frequency domain signal supplied from the switch 159, adds up the time domain signal obtained thereby on the basis of the window function W[J], and obtains an audio PCM signal T'2[J]. The inverse MDCT unit 160 outputs the PCM signal T'2[J] as an audio signal.

Description of PCM Signal at the Time of Loss

Figure 21:
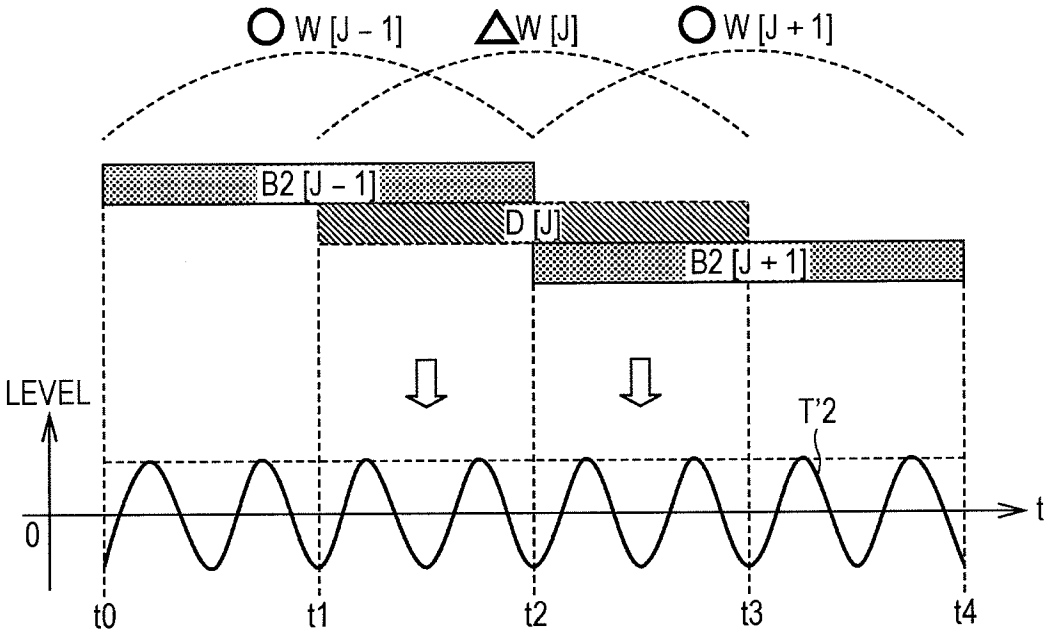
FIG. 21 illustrates a PCM signal in a case where data is lost.

FIG. 21 illustrates PCM signals T2[J−1] to T2[J+1] in a case where data B2[J] is lost.

As shown in FIG. 21, in a case where the data B2[J] is lost, a spectrum S[J] obtained from the data D[J] contained in the bit stream B1[J−1] of the previous frame, which is received earlier than the data B2[J], is selected by the switch 159. That is, as shown in FIG. 21, the spectrum S[J] that should be generated using data B2[J] is interpolated by the spectrum S[J] that is generated by the data D[J] contained in the bit stream B1[J−1], which is received earlier than the data B2[J]. Since the data D[J] does not contain an envelope, the spectrum S[J] is generated by using the envelope F2[J−1] contained in the data B2[J−1] in the same bit stream B1[J−1].

Description of Processing of Decoding Apparatus

Figure 22:
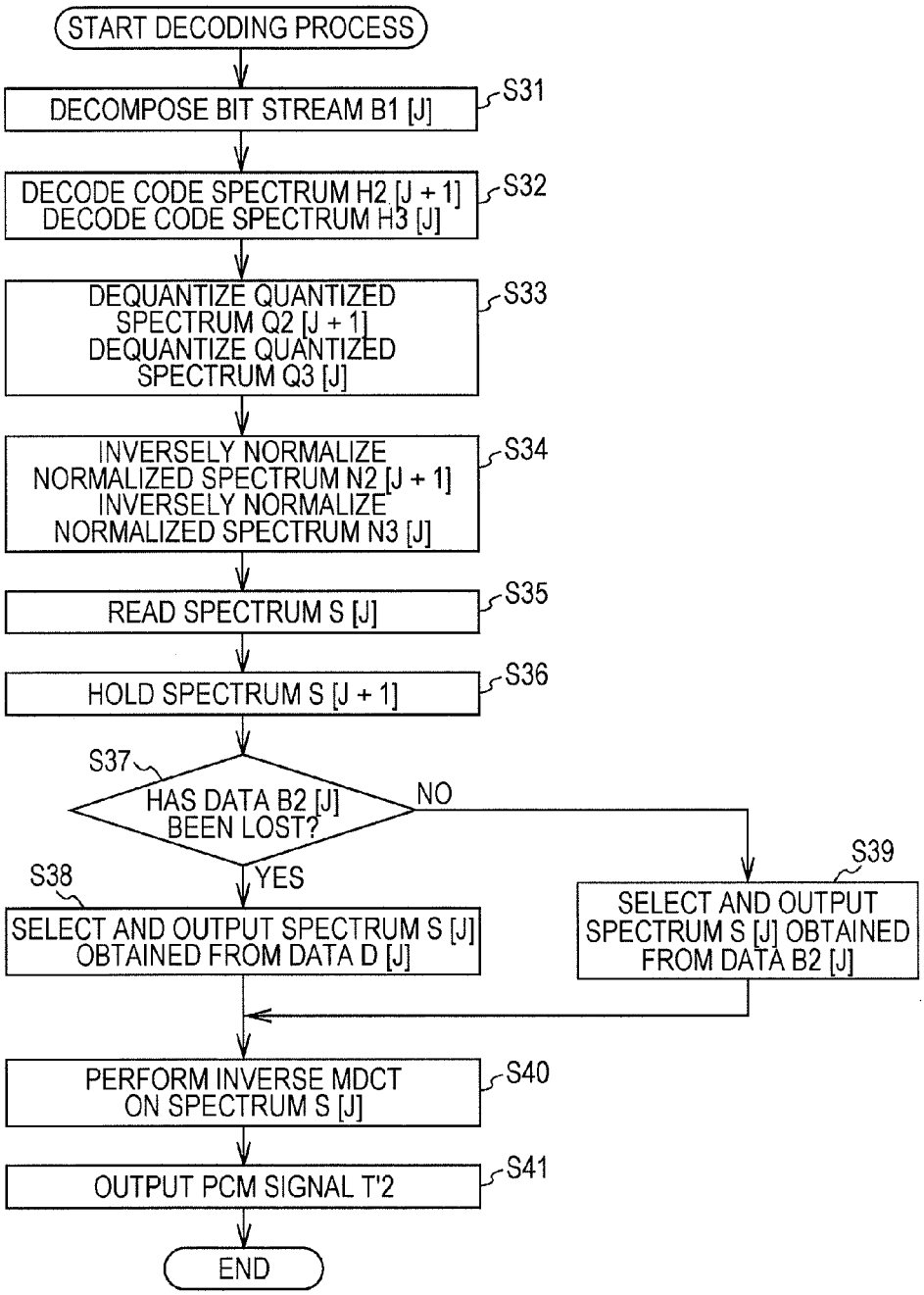
FIG. 22 is a flowchart illustrating a decoding process performed by the decoding apparatus of FIG. 20.

FIG. 22 is a flowchart illustrating a decoding process performed by the decoding apparatus 150 of FIG. 20. This decoding process is started when, for example, a bit stream B1[J], which is a coded result by the coding apparatus 100, is input to the decoding apparatus 150.

In step S31, the decomposition unit 151 decomposes the bit stream B1[J] into an envelope F2[J], quantization accuracy information P2[J+1], and quantization accuracy information P3[J]. Furthermore, the decomposition unit 151 decomposes the bit stream B1[J] into a code spectrum H2[J+1] on the basis of the quantization accuracy information P2[J+1], and decomposes the bit stream B1[J] into a code spectrum H3[J] on the basis of the quantization accuracy information P3[J].

Then, the decomposition unit 151 supplies the envelope F2[J] to the inverse normalization unit 154 and the inverse normalization unit 158. The decomposition unit 151 supplies the quantization accuracy information P2[J+1] to the dequantization unit 153, and supplies the quantization accuracy information P3[J] to the dequantization unit 157. In addition, the decomposition unit 151 supplies the code spectrum H2[J+1] to the decoding unit 152, and supplies the code spectrum H3[J] to the decoding unit 156.

In step S32, the decoding unit 152 decodes the code spectrum H2[J+1] supplied from the decomposition unit 151, and supplies the quantized spectrum Q2[J+1] obtained thereby to the dequantization unit 153. At the same time, the decoding unit 156 decodes the code spectrum H3[J] supplied from the decomposition unit 151, and supplies the quantized spectrum Q3[J] obtained thereby to the dequantization unit 157.

In step S33, the dequantization unit 153 dequantizes the quantized spectrum Q2[J+1] supplied from the decoding unit 152 on the basis of the quantization accuracy information P2[J+1] supplied from the decomposition unit 151, and supplies the normalized spectrum N2[J+1] obtained thereby to the inverse normalization unit 154. At the same time, the dequantization unit 157 dequantizes the quantized spectrum Q3[J] supplied from the decoding unit 156 on the basis of the quantization accuracy information P3[J] supplied from the decomposition unit 151, and supplies the normalized spectrum N3[J] obtained thereby to the inverse normalization unit 158.

In step S34, the inverse normalization unit 154 inversely normalizes the normalized spectrum N2[J+1] supplied from the dequantization unit 153 by using the envelope F2[J] supplied from the decomposition unit 151, and supplies the spectrum S[J+1] obtained thereby to the holding unit 155. At the same time, the inverse normalization unit 158 inversely normalizes the normalized spectrum N3[J] supplied from the dequantization unit 157 by using the envelope F2[J] supplied from the decomposition unit 151, and supplies the spectrum S[J] obtained thereby to the switch 159.

In step S35, the holding unit 155 reads the spectrum S[J], which has already been held, and outputs it to the switch 159.

In step S36, the holding unit 155 holds the spectrum S[J+1] supplied from the inverse normalization unit 154.

In step S37, the switch 159 determines whether or not the data 32[J] has been lost on the basis of the detection results E1[J] supplied from the decomposition unit 151, the decoding unit 156, the dequantization unit 157, and the inverse normalization unit 158.

When it is determined in step S37 that the data B2[J] has been lost, in step S38, the switch 159 selects the spectrum S[J] obtained from the data D[J] supplied from the holding unit 155, and outputs the spectrum S[J] to the inverse MDCT unit 160. Then, the process proceeds to step S40.

On the other hand, when it is determined in step S37 that the data B2[J] has not been lost, in step S39, the switch 159 selects the spectrum S[J] obtained from the data B2[J] supplied from the inverse normalization unit 158, and outputs the spectrum S[J] to the to the inverse MDCT unit 160. Then, the process proceeds to step S40.

In step S40, the inverse MDCT unit 160 performs inverse MDCT on the spectrum S[J] that is a frequency domain signal supplied from the switch 159, adds up the time domain signal obtained thereby, and obtains an audio PCM signal T'2[J].

In step S41, the inverse MDCT unit 160 outputs the PCM signal T'2[J] as an audio signal, and the processing is completed.

In the above-mentioned description, although the envelope F2 is made common to the spectrum S[J+1] and the spectrum S[J], quantization accuracy information that is another information (coding information) used for coding may made common.

Furthermore, the coding unit 105 may perform differential coding that codes a difference between the quantized spectrum Q2[J+1] and the quantized spectrum Q3[J]. In this case, the decoding unit 152 decodes the code spectrum H2[J+1], combines the decoded result of the code spectrum H2[J+1] and the decoded result of the code spectrum H3[J], and generates a quantized spectrum Q2[J+1]. In a case where differential coding is used in the manner described above, coding efficiency is improved, and the bit rate can be further reduced.

In addition, in the above-mentioned description, the PCM signal T[J] that is input to the coding apparatus 100 is made to be a signal for one channel, and alternatively may be a signal for a plurality of channels. In this case, a code stream of different frames is not arranged in the bit stream B1[J], but a code stream of different channels is arranged therein. For example, in the bit stream B1[J], coded data of a predetermined frame of a predetermined channel, and coded data of the same frame as that of the predetermined coded data and of a channel different from that of the predetermined coded data are arranged.

Description of Computer to which the Present Disclosure is Applied

Next, the above-mentioned series of processes of the coding apparatus 100 and the decoding apparatus 150 can be performed by hardware and also by software. In a case where the above-mentioned series of processes of the coding apparatus 100 and the decoding apparatus 150 are to be performed by software, a program forming the software is installed into a general-purpose computer or the like.

Figure 23:
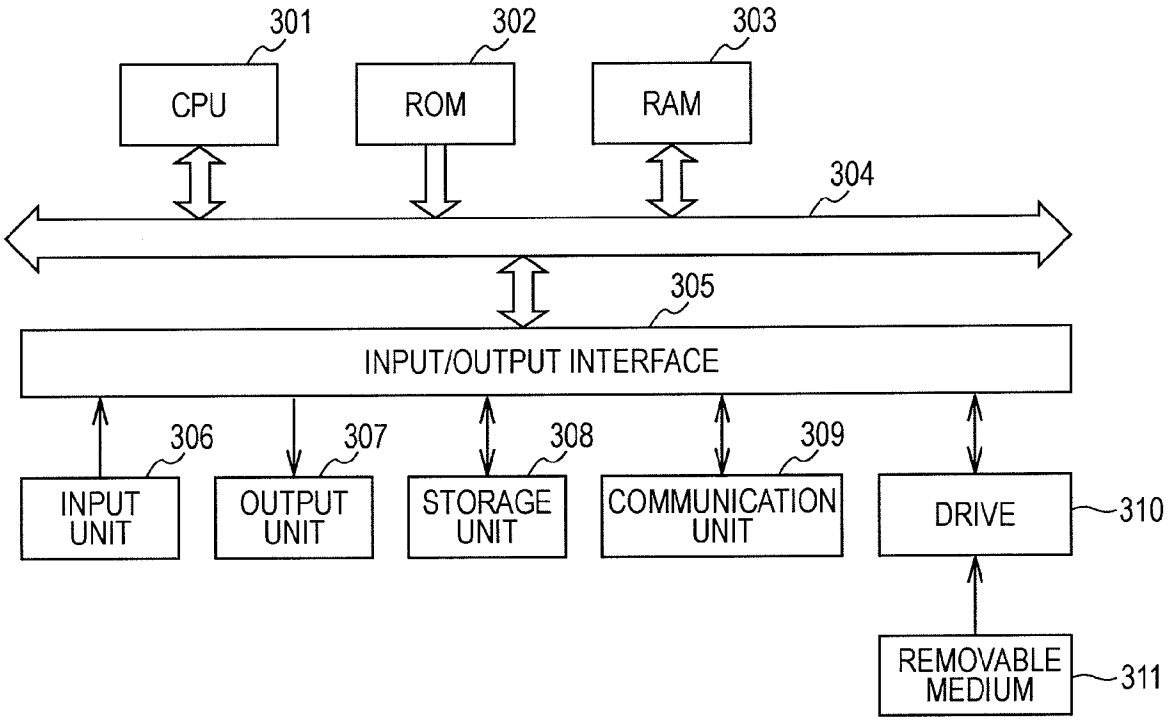
FIG. 23 illustrates an example of the configuration of an embodiment of a computer.

FIG. 23 illustrates an example of the configuration of an embodiment of a computer to which a program for executing the above-mentioned series of processes is installed.

The program can be recorded in advance in a storage unit 308 and a read only memory (ROM) 302 serving as recording media that are incorporated into the computer.

Alternatively, the program can be stored (recorded) on a removable medium 311. Such a removable medium 311 can be provided as so-called packaged software. Here, examples of the removable media 311 include a flexible disk, a compact disc-read only memory (CD-ROM), a magneto optical (MO) disc, a digital versatile disc (DVD), a magnetic disc, and a semiconductor memory.

In addition to installing the program from the removable medium 311 described above to the computer through the drive 310, it is possible to download the program into the computer through a communication network and a broadcast network and install the program into the incorporated storage unit 308. That is, for example, the program can be transferred wirelessly from a download site to a computer through an artificial satellite for a digital satellite broadcast, or can be transferred to the computer by wire through a network, such as a local area network (LAN) or the Internet.

The computer has a central processing unit (CPU) 301 incorporated therein, and an input/output interface 305 is connected to the CPU 301 through a bus 304.

When an instruction is input to the CPU 301 as a result of an input unit 306 being operated by a user through the input/output interface 305, the CPU 301 executes a program stored in a ROM 302 in accordance with the instruction. Alternatively, the CPU 301 loads a program stored in the storage unit 308 into a random access memory (RAM) 303 and executes the program.

As a result, the CPU 301 performs processing in accordance with the above-mentioned flowchart or the structure of the above-described block diagram. Then, the CPU 301 causes the processing result, for example, to be output from an output unit 307, to be transmitted from a communication unit 309, or to be recorded in the storage unit 308 through the input/output interface 305 as necessary.

The input unit 306 includes a keyboard, a mouse, a mic, and the like. Furthermore, the output unit 307 includes a liquid crystal display (LCD), a speaker, and the like.

In this specification, processes performed by a computer in accordance with a program is not necessary to be performed in a time-series manner along the sequence described as a flowchart. That is, processes performed by the computer in accordance with a program include processes that are performed in parallel or individually (for example, parallel processes or object-based processes).

Furthermore, the program may be performed by one computer (processor) or may also be distributed-processed by a plurality of computers. In addition, the program may be transferred to a distant computer and executed thereby.

In addition, the embodiments of the present disclosure are not limited to the above-described embodiments, and various changes are possible in a range not deviating from the spirit and scope of the present disclosure.

The present disclosure contains subject matter related to that disclosed in Japanese Priority Patent Application JP 2010-126780 filed in the Japan Patent Office on Jun. 2, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A coding apparatus comprising:

a memory storing instructions; and a processor configured to execute the instructions to:

generate first coding information that is information used for first coding of a first audio signal that is an audio signal in a frame unit and second coding information that is information used for second coding of a second audio signal that is an audio signal in a frame unit, the second audio signal being different from the first audio signal, in such a manner that the first coding information and the second coding information share at least a common portion, and configured to generate third coding information that is information used for the first coding of the second audio signal and fourth coding information that is information used for the second coding of a third audio signal that is an audio signal in a frame unit, the third audio signal being different from the first and second audio signals, in such a manner that the third coding information and the fourth coding information share at least a common portion;

generate first data by performing the first coding on the first audio signal by using the first coding information and configured to generate second data by performing the first coding on the second audio signal by using the third coding information;

generate third data by performing the second coding on the second audio signal by using the second coding information and configured to generate fourth data by performing the second coding on the third audio signal by using the fourth coding information; and generate a stream of the first audio signal by multiplexing the first coding information, the third data, the second coding information, and information other than a portion common to the first coding information within the first data, and configured to generate a stream of the second audio signal by multiplexing the third coding information, the fourth data, and the fourth coding information other than a portion common to the third coding information within the second data, wherein the third data is decoded in place of the second data contained in the stream of the second audio signal in a case where a loss or an error has occurred in the stream of the second audio signal in a decoding apparatus that decodes the first audio signal and the second audio signal.

2. The coding apparatus according to claim 1, wherein the processor is further configured to execute the instructions to generate the first coding information and the second coding information containing an envelope common to the first audio signal and the second audio signal, and generate the third coding information and the fourth coding information containing an envelope common to the second audio signal and the third audio signal.

3. The coding apparatus according to claim 1, wherein the processor is further configured to execute the instructions to generate the first coding information and the second coding information containing quantization accuracy information common to the first audio signal and the second audio signal, and generate the third coding information and the fourth coding information containing quantization accuracy information common to the second audio signal and the third audio signal.

4. The coding apparatus according to claim 1, wherein a frame corresponding to the first audio signal, a frame corresponding to the second audio signal, and a frame corresponding to the third audio signal differ from one another.

5. The coding apparatus according to claim 4, wherein the frame corresponding to the first audio signal is a frame before the frame corresponding to the second audio signal, and the frame corresponding to the second audio signal is a frame before the frame corresponding to the third audio signal.

6. The coding apparatus according to claim 1, wherein a channel corresponding to the first audio signal and a channel corresponding to the third audio signal differ from the channel corresponding to the second audio signal.

7. A coding method comprising:

generating first coding information that is information used for first coding of a first audio signal that is an audio signal in a frame unit and second coding information that is information used for second coding of a second audio signal that is an audio signal in a frame unit, the second audio signal being different from the first audio signal, in such a manner that the first coding information and the second coding information share at least a common portion, and generating third coding information that is information used for the first coding of the second audio signal and fourth coding information that is information used for the second coding of a third audio signal that is an audio signal in a frame unit, the third audio signal being different from the first and second audio signals, in such a manner that the third coding information and the fourth coding information share at least a common portion;

generating first data by performing the first coding on the first audio signal by using the first coding information and generating second data by performing the first coding on the second audio signal by using the third coding information;

generating third data by performing the second coding on the second audio signal by using the second coding information and generating fourth data by performing the second coding on the third audio signal by using the fourth coding information; and generating a stream of the first audio signal by multiplexing the first data, the first coding information, the third data, and information other than a portion common to the first coding information within the second coding information, and generating a stream of the second audio signal by multiplexing the second data, the third coding information, the fourth data, and information other than a portion common to the third coding information within the fourth coding information, wherein the third data is decoded in place of the second data contained in the stream of the second audio signal in a case where a loss or an error has occurred in the stream of the second audio signal in a decoding apparatus that decodes the first audio signal and the second audio signal.

8. A non-transitory computer-readable storage medium storing computer-executable program instructions that, when executed by a processor, perform a processing method, the method comprising:

generating first coding information that is information used for first coding of a first audio signal that is an audio signal in a frame unit and second coding information that is information used for second coding of a second audio signal that is an audio signal in a frame unit, the second audio signal being different from the first audio signal, in such a manner that the first coding information and the second coding information share at least a common portion, and generating third coding information that is information used for the first coding of the second audio signal and fourth coding information that is information used for the second coding of a third audio signal that is an audio signal in a frame unit, the third audio signal being different from the first and second audio signals, in such a manner that the third coding information and the fourth coding information share at least a common portion;

generating first data by performing the first coding on the first audio signal by using the first coding information and generating second data by performing the first coding on the second audio signal by using the third coding information;

generating third data by performing the second coding on the second audio signal by using the second coding information and generating fourth data by performing the second coding on the third audio signal by using the fourth coding information; and generating a stream of the first audio signal by multiplexing the first data, the first coding information, the third data, and information other than a portion common to the first coding information within the second coding information, and generating a stream of the second audio signal by multiplexing the second data, the third coding information, the fourth data, and information other than a portion common to the third coding information within the fourth coding information, wherein the third data is decoded in place of the second data contained in the stream of the second audio signal in a case where a loss or an error has occurred in the stream of the second audio signal in a decoding apparatus that decodes the first audio signal and the second audio signal.

9. A decoding apparatus comprising:

a memory storing instructions; and a processor configured to execute the instructions to:

obtain a stream of a first audio signal obtained by multiplexing first data obtained as a result of performing first coding on the first audio signal that is an audio signal in a frame unit by using first coding information, the first coding information, second data obtained as a result of performing second coding on a second audio signal that is an audio signal in a frame unit, the second audio signal being different from the first audio signal, by using second coding information, at least a portion of the second coding information being common to the first coding information, and information other than a portion common to the first coding information within the second coding information, and configured to obtain a stream of the second audio signal obtained by multiplexing third data obtained as a result of performing the first coding on the second audio signal by using the third coding information, the third coding information, fourth data obtained as a result of performing the second coding on a third audio signal that is an audio signal in a frame unit, the third audio signal being different from the first and second audio signals by using fourth coding information, at least a portion of the fourth coding information being common to the third coding information, and information other than a portion common to the third coding information within the fourth coding information;

perform first decoding on the first data on the basis of the first coding information and configured to perform the first decoding on the third data on the basis of the third coding information;

perform second decoding on the second data on the basis of the first coding information and the second coding information and configured to perform the second decoding on the fourth data on the basis of the third coding information and the fourth coding information; and output a decoded result of the second data in place of a decoded result of the third data contained in the stream of the second audio signal in a case where a loss or an error has occurred in the stream of the second audio signal, and configured to output a decoded result of the third data contained in the stream of the second audio signal in a case where a loss or an error has not occurred in the stream of the second audio signal.

10. The decoding apparatus according to claim 9, wherein the first coding information and the second coding information contain an envelope common to the first audio signal and the second audio signal, and the third coding information and the fourth coding information contain an envelope common to the second audio signal and the third audio signal.

11. The decoding apparatus according to claim 9, wherein the first coding information and the second coding information contain quantization accuracy information common to the first audio signal and the second audio signal, and the third coding information and the fourth coding information contain quantization accuracy information common to the second audio signal and the third audio signal.

12. The decoding apparatus according to claim 9, wherein a frame corresponding to the first audio signal, a frame corresponding to the second audio signal, and a frame corresponding to the third audio signal differ from one another.

13. The decoding apparatus according to claim 12, wherein the frame corresponding to the first audio signal is a frame before the frame corresponding to the second audio signal, and the frame corresponding to the second audio signal is a frame before the frame corresponding to the third audio signal.

14. The decoding apparatus according to claim 9, wherein a channel corresponding to the first audio signal and a channel corresponding to the third audio signal differs from the channel corresponding to the second audio signal.

15. A decoding method comprising:

obtaining a stream of a first audio signal obtained by multiplexing first data obtained as a result of performing first coding on the first audio signal that is an audio signal in a frame unit by using first coding information, the first coding information, second data obtained as a result of performing second coding on a second audio signal that is an audio signal in a frame unit, the second audio signal being different from the first audio signal, by using second coding information, at least a portion of the second coding information being common to the first coding information, and information other than a portion common to the first coding information within the second coding information, and obtaining a stream of the second audio signal obtained by multiplexing third data obtained as a result of performing the first coding on the second audio signal by using the third coding information, the third coding information, fourth data obtained as a result of performing the second coding on a third audio signal that is an audio signal in a frame unit, the third audio signal being different from the first and second audio signals, by using fourth coding information, at least a portion of the fourth coding information being common to the third coding information, and information other than a portion common to the third coding information within the fourth coding information;

performing first coding on the first data on the basis of the first coding information and performing the first decoding on the third data on the basis of the third coding information;

performing second coding on the second data on the basis of the second coding information and performing the second coding on the fourth data on the basis of the third coding information and the fourth coding information; and outputting a decoded result of the second data in place of the decoded result of the third data contained in the stream of the second audio signal in a case where a loss or an error has occurred in the stream of the second audio signal, and outputting a decoded result of the third data contained in the stream of the second audio signal in a case where a loss or an error has not occurred in the stream of the second audio signal.

16. A non-transitory computer-readable storage medium storing computer-executable program instructions that, when executed by a processor, perform a processing method, the method comprising:

obtaining a stream of a first audio signal obtained by multiplexing first data obtained as a result of performing first coding on the first audio signal that is an audio signal in a frame unit by using first coding information, the first coding information, second data obtained as a result of performing second coding on a second audio signal that is an audio signal in a frame unit, the second audio signal being different from the first audio signal, by using second coding information, at least a portion of the second coding information being common to the first coding information, and information other than a portion common to the first coding information within the second coding information, and obtaining a stream of the second audio signal obtained by multiplexing third data obtained as a result of performing the first coding on the second audio signal by using the third coding information, the third coding information, fourth data obtained as a result of performing the second coding on a third audio signal that is an audio signal in a frame unit, the third audio signal being different from the first and second audio signals, by using fourth coding information, at least a portion of the fourth coding information being common to the third coding information, and information other than a portion common to the third coding information within the fourth coding information;

performing first coding on the first data on the basis of the first coding information and performing the first decoding on the third data on the basis of the third coding information;

performing second coding on the second data on the basis of the second coding information and performing the second coding on the fourth data on the basis of the third coding information and the fourth coding information; and outputting a decoded result of the second data in place of the decoded result of the third data contained in the stream of the second audio signal in a case where a loss or an error has occurred in the stream of the second audio signal, and outputting a decoded result of the third data contained in the stream of the second audio signal in a case where a loss or an error has not occurred in the stream of the second audio signal.

* * * * *